US009490578B2

(12) United States Patent
Wu et al.

(10) Patent No.: US 9,490,578 B2
(45) Date of Patent: Nov. 8, 2016

(54) ELECTRICAL CONNECTOR ASSEMBLY HAVING GUIDING MEANS

(71) Applicant: FOXCONN INTERCONNECT TECHNOLOGY LIMITED, Grand Cayman (KY)

(72) Inventors: Jerry Wu, Irvine, CA (US); Jian-Jun Zhu, Kunshan (CN); Qing-Man Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/710,930

(22) Filed: May 13, 2015

(65) Prior Publication Data

US 2015/0333448 A1 Nov. 19, 2015

(30) Foreign Application Priority Data

May 13, 2014 (CN) ..... 2014 1 0199257
May 13, 2014 (CN) ..... 2014 1 0199258
May 13, 2014 (CN) ..... 2014 1 0199259
May 14, 2014 (CN) ..... 2014 1 0200729

(51) Int. Cl.
*H01R 13/642* (2006.01)
*H01R 13/62* (2006.01)
*H01R 12/72* (2011.01)
*H01R 13/24* (2006.01)

(52) U.S. Cl.
CPC ..... *H01R 13/642* (2013.01); *H01R 13/6205* (2013.01); *H01R 12/724* (2013.01); *H01R 13/24* (2013.01)

(58) Field of Classification Search
CPC ..... H01R 13/6205
USPC ..... 439/39, 680
See application file for complete search history.

(56) References Cited

U.S. PATENT DOCUMENTS 6,340,320 B1 1/2002 Ogawa
7,247,046 B1 * 7/2007 Wu ..... H01R 13/6691 439/490
7,311,526 B2 12/2007 Rohrbach et al.
7,329,151 B2 * 2/2008 Wu ..... H01R 13/5808 439/456
7,341,458 B1 3/2008 Koh
7,632,134 B2 12/2009 Su et al.
7,914,320 B2 * 3/2011 Ko ..... H01R 13/502 439/490
8,535,088 B2 9/2013 Gao et al.
8,894,419 B1 * 11/2014 Buelow ..... H01R 13/6205 439/218
9,065,205 B2 * 6/2015 Gao ..... H01R 13/5808
2008/0003841 A1 * 1/2008 Su ..... H01R 13/44 439/55

(Continued)

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector assembly includes: a first connector including a mating section, a first magnetic element having a cavity, and a number of first contacts accommodated in the mating section and the cavity; a second connector for mating with the mating section, the second connector including a second magnetic element and a number of second contacts accommodated in the second magnetic element; and an anti-mismating structure located at a front end of the second connector. The structure includes a number of anti-mismating elements and an anti-mismating hole surrounded by the anti-mismating elements for receiving the mating section. The anti-mismating hole is asymmetric in one of an up-to-down direction and a left-to-right direction, and the periphery of the mating section corresponds to the anti-mismating hole.

12 Claims, 32 Drawing Sheets

(56) References Cited

U.S. PATENT DOCUMENTS

2011/0097942 A1* 4/2011 Dooley ..... H01R 13/6272
439/676

2013/0210244 A1 8/2013 DiFonzo et al.

2014/0256163 A1* 9/2014 Kuo ..... H01R 13/6205
439/39

* cited by examiner

ELECTRICAL CONNECTOR ASSEMBLY HAVING GUIDING MEANS

BACKGROUND OF THE INVENTION

1. Field of the Invention

The present invention relates generally to an electrical connector assembly, and more particularly to an electrical connector assembly having guiding means.

2. Description of Related Arts

U.S. Pat. No. 7,632,134, issued on Dec. 15, 2009, discloses a magnetic connector including a mating section, a magnetic element having a cavity, and a number of retractable, POGO-type contacts accommodated in the mating section and the cavity. The magnetic connector further includes a terminal block receiving the contacts, an internal printed circuit board, and a protective member.

U.S. Pat. No. 7,311,526, issued on Dec. 25, 2007, discloses an electrical plug and receptacle relying on magnetic force to maintain coupling. Each of the plug and the receptacle comprises a magnetic element and a plurality of contacts accommodated in the magnetic member. Also disclosed are complementary guides that allow for only one way of coupling the plug and receptacle together to ensure proper alignment of the plug contacts with the receptacle contacts. An electrical connector assembly having guiding means is desired.

SUMMARY OF THE INVENTION

Accordingly, an object of the present invention is to provide an electrical connector assembly having guiding means.

To achieve the above object, an electrical connector assembly comprises: a first connector comprising a mating section, a first magnetic element having a cavity, and a plurality of first contacts accommodated in the mating section and the cavity; a second connector for mating with the mating section, the second connector comprising a second magnetic element and a plurality of second contacts accommodated in the second magnetic element; and an anti-mismating structure located at a front end of the second connector, the structure comprising a plurality of anti-mismating elements and an anti-mismating hole surrounded by the anti-mismating elements, the anti-mismating hole for receiving the mating section, wherein the anti-mismating hole is asymmetric in one of an up-to-down direction and a left-to-right direction, and the periphery of the mating section corresponds to the anti-mismating hole.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
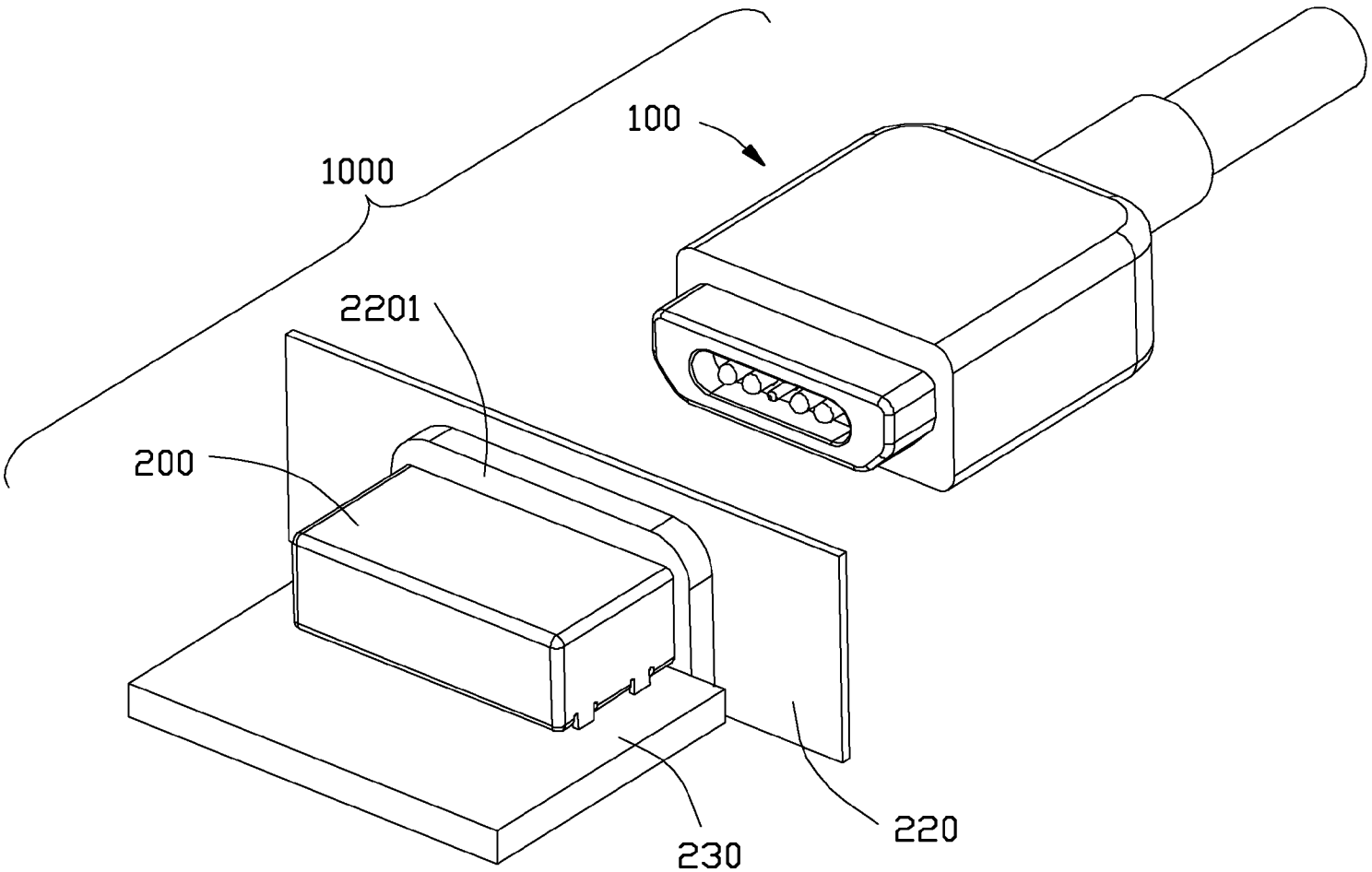
FIG. 1 is a perspective, assembled view of an electrical connector assembly when a first connector is not mated with a second connector in accordance with the first embodiment of the present invention.
Figure 2:
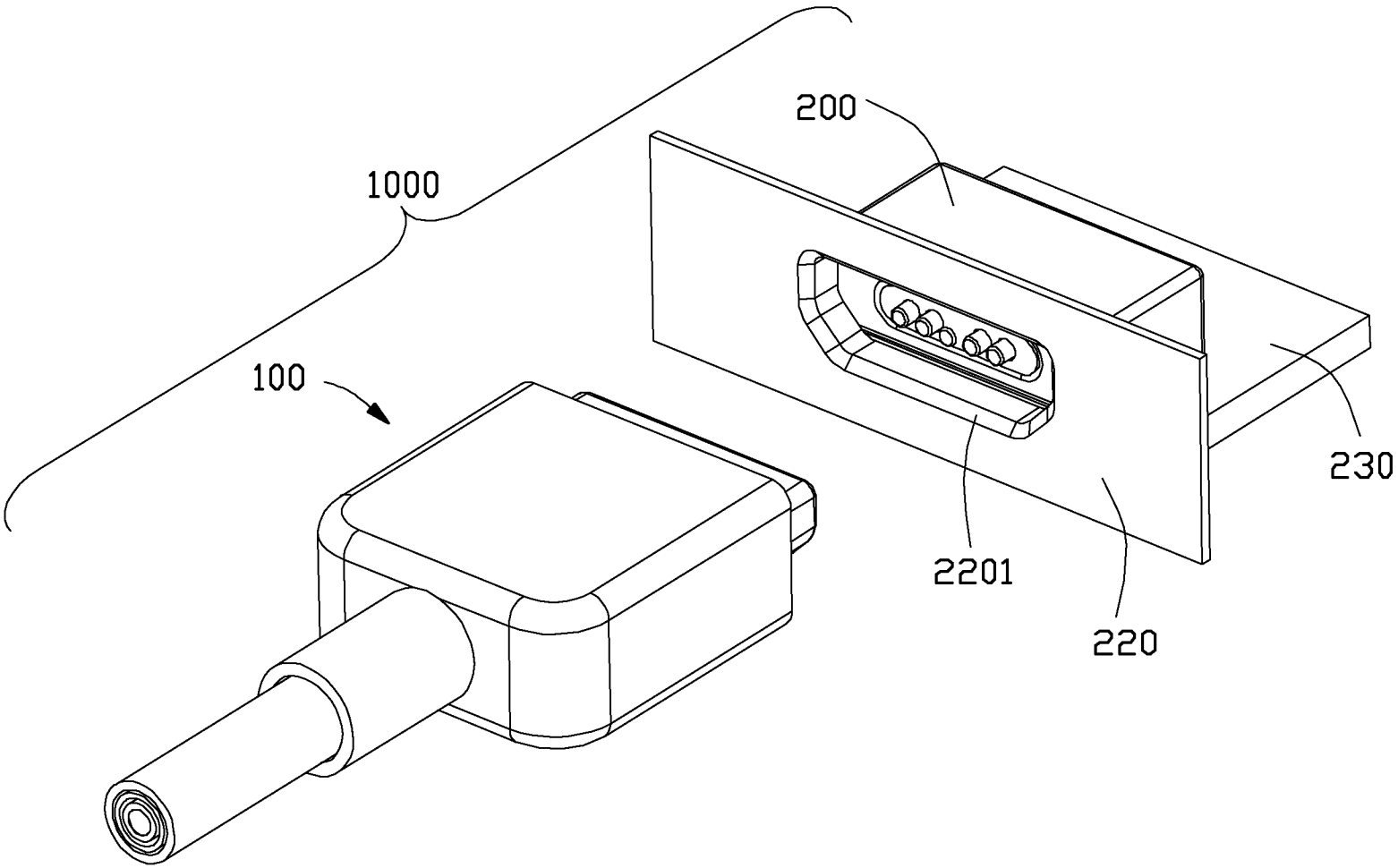
FIG. 2 is a perspective, assembled view of the electrical connector assembly, taken from a different view shown in FIG. 1.
Figure 3:
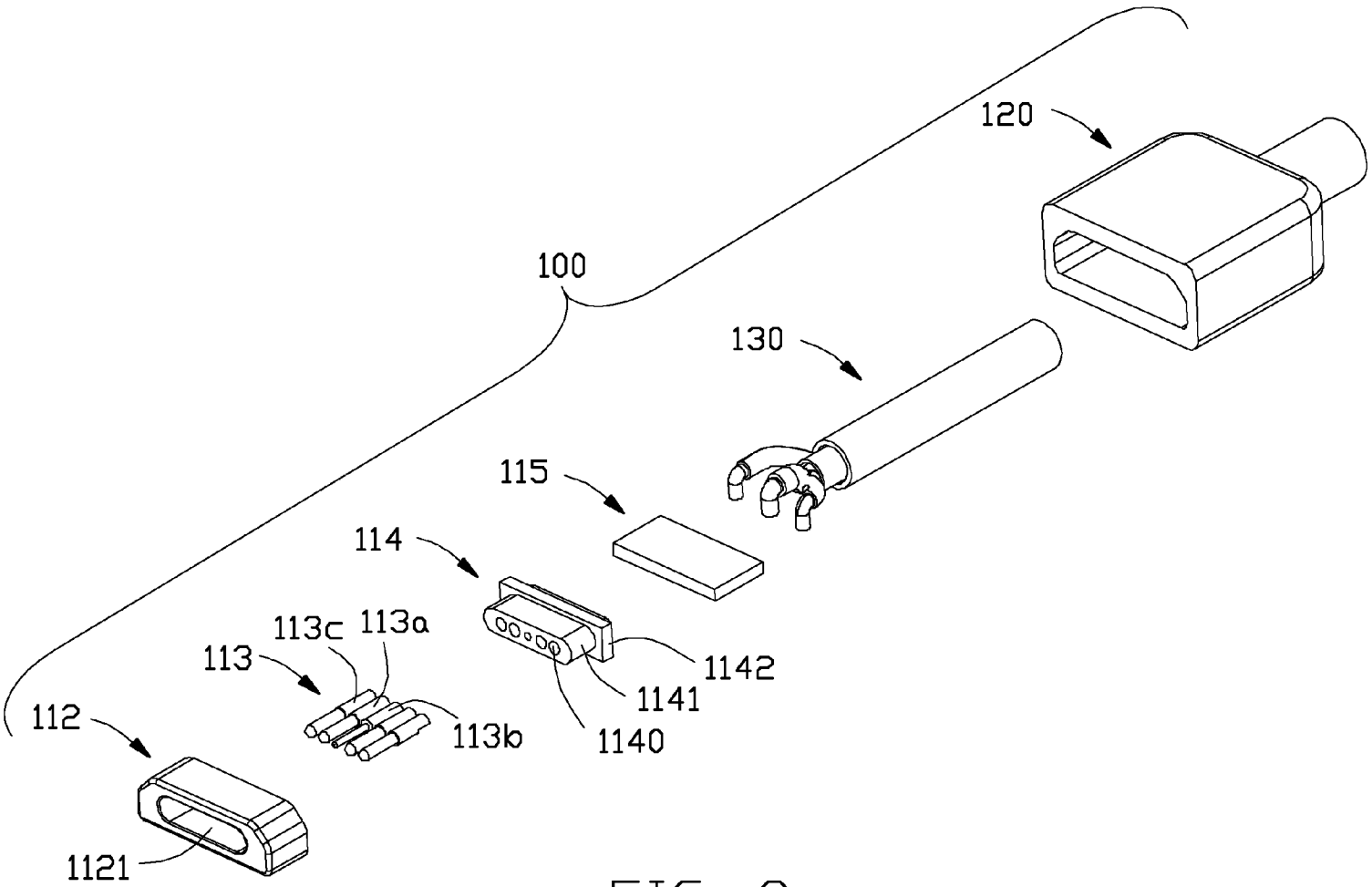
FIG. 3 is a perspective, exploded view of the first connector of the electrical connector assembly shown in FIG. 2.
Figure 4:
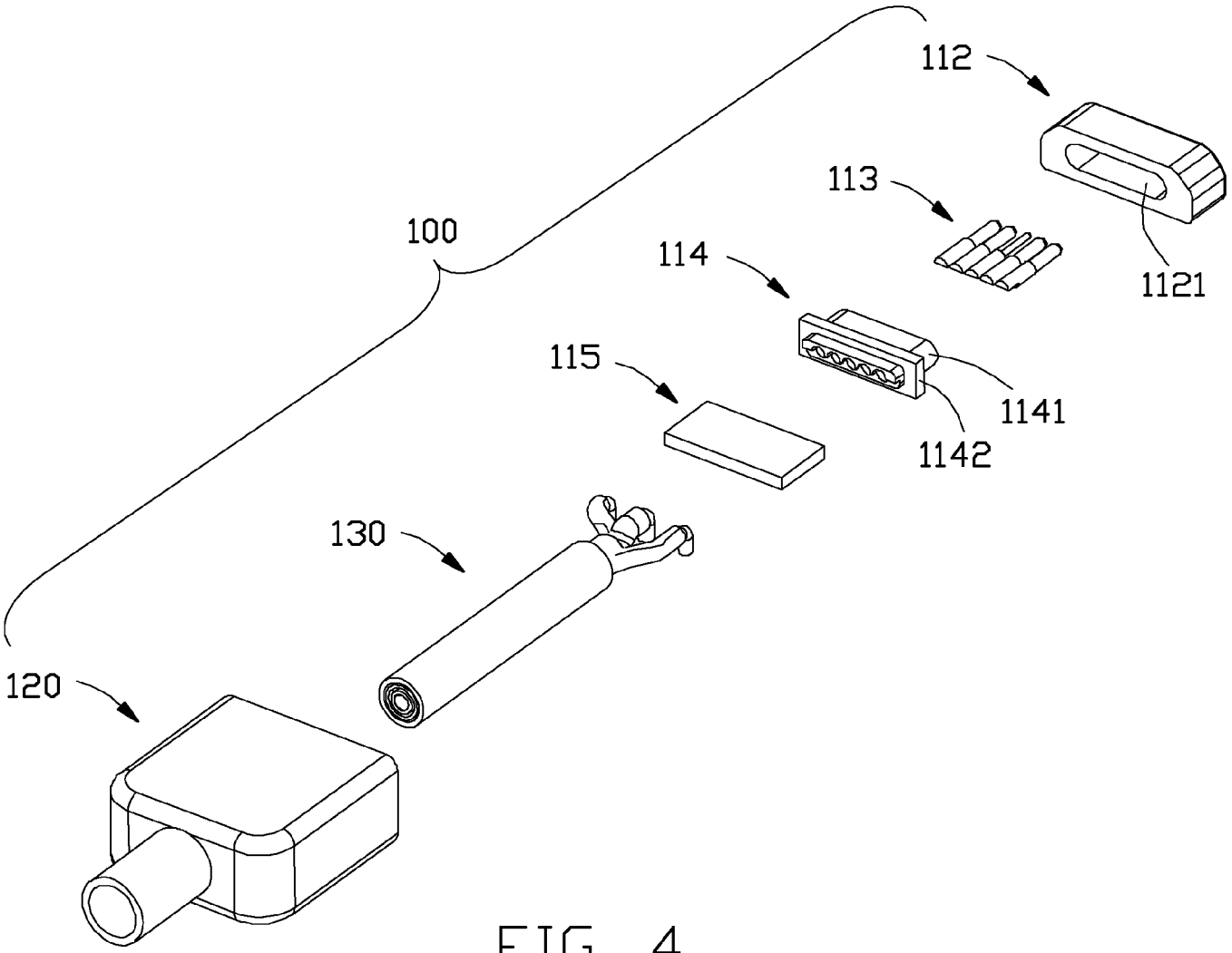
FIG. 4 is a perspective, exploded view of the first connector taken from a different view shown in FIG. 3.
Figure 5:
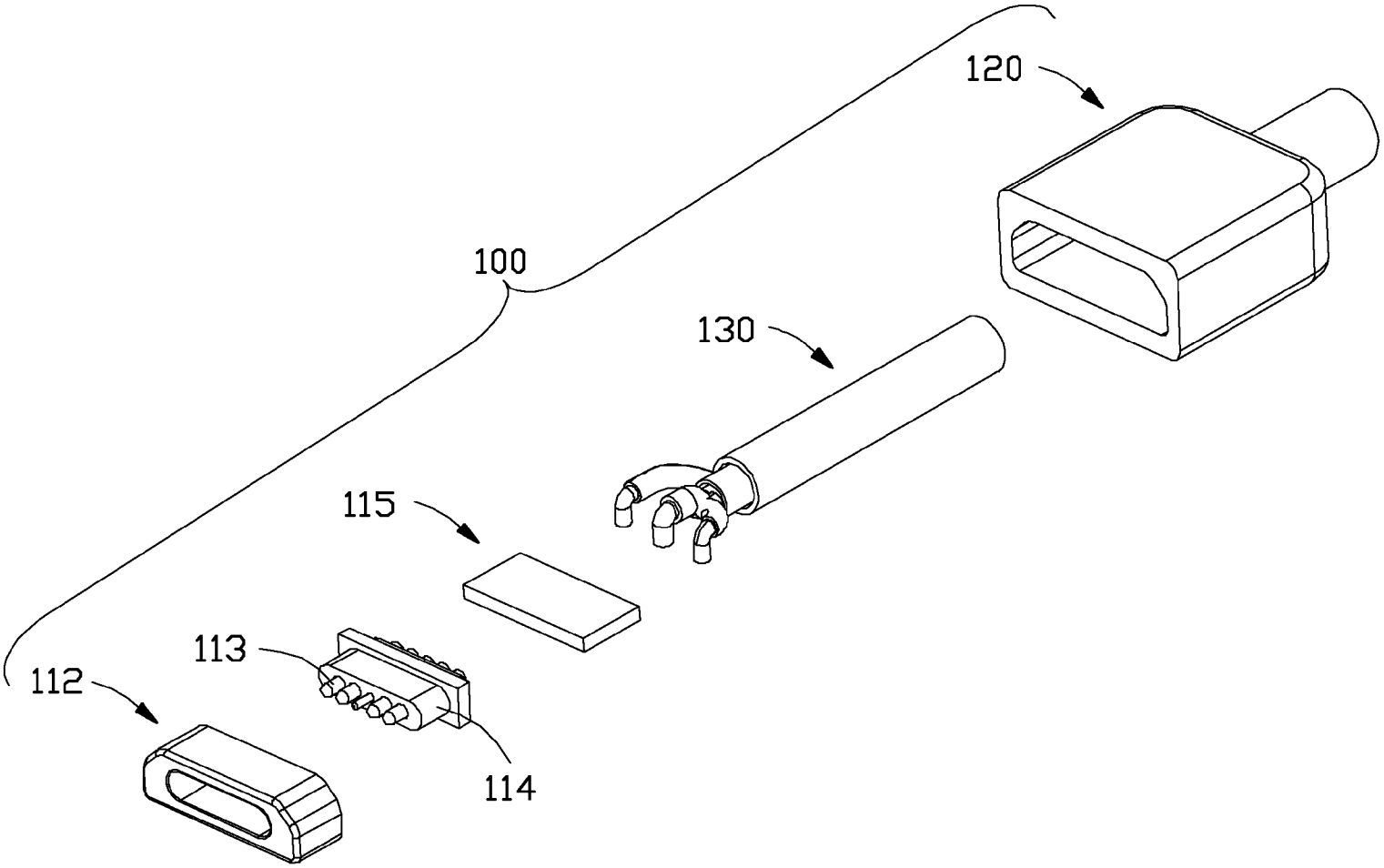
FIG. 5 is a perspective, partially assembled view of the first connector shown in FIG. 3.
Figure 6:
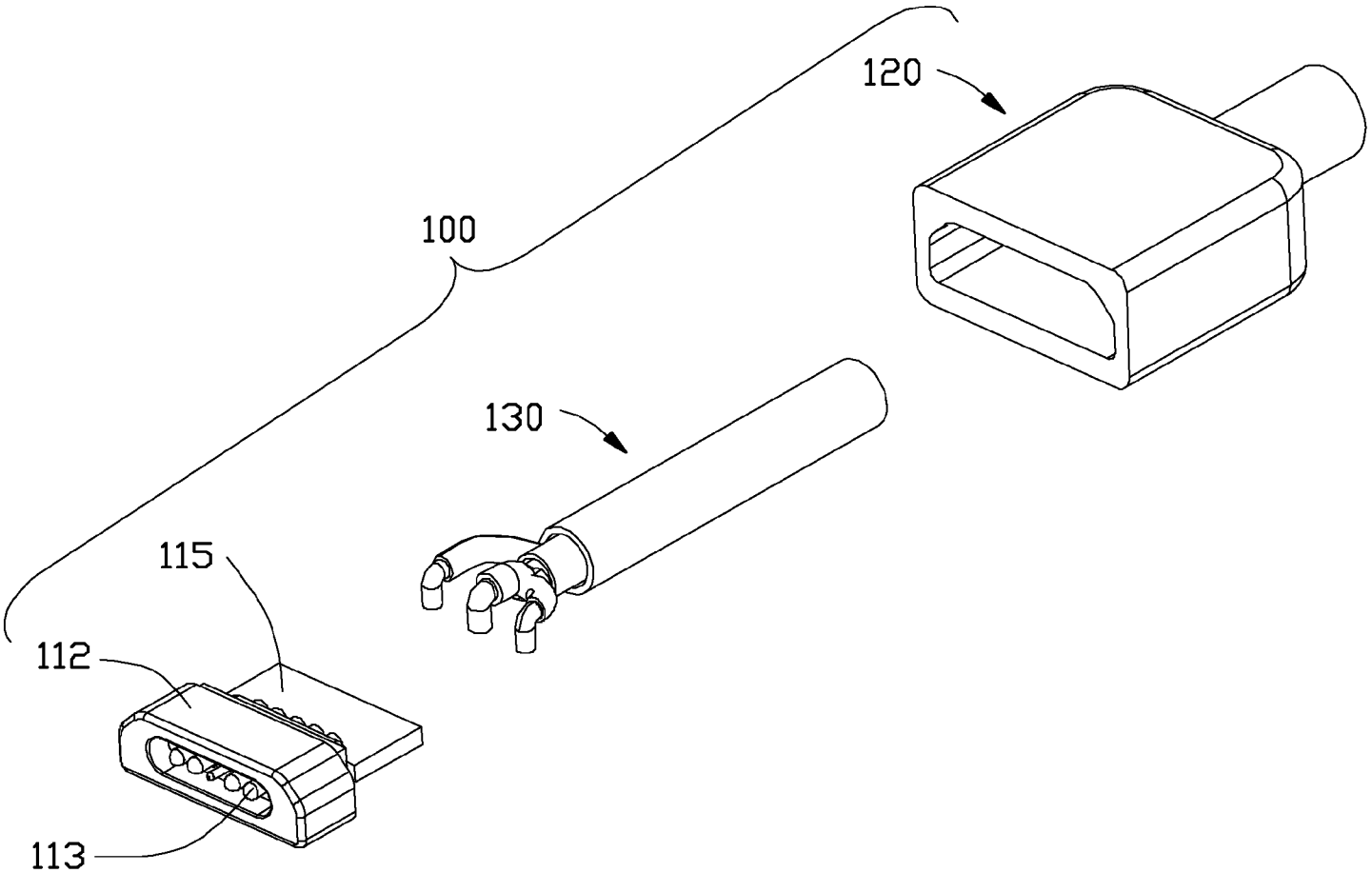
FIG. 6 is a perspective, further assembled view of the first connector shown in FIG. 5.
Figure 7:
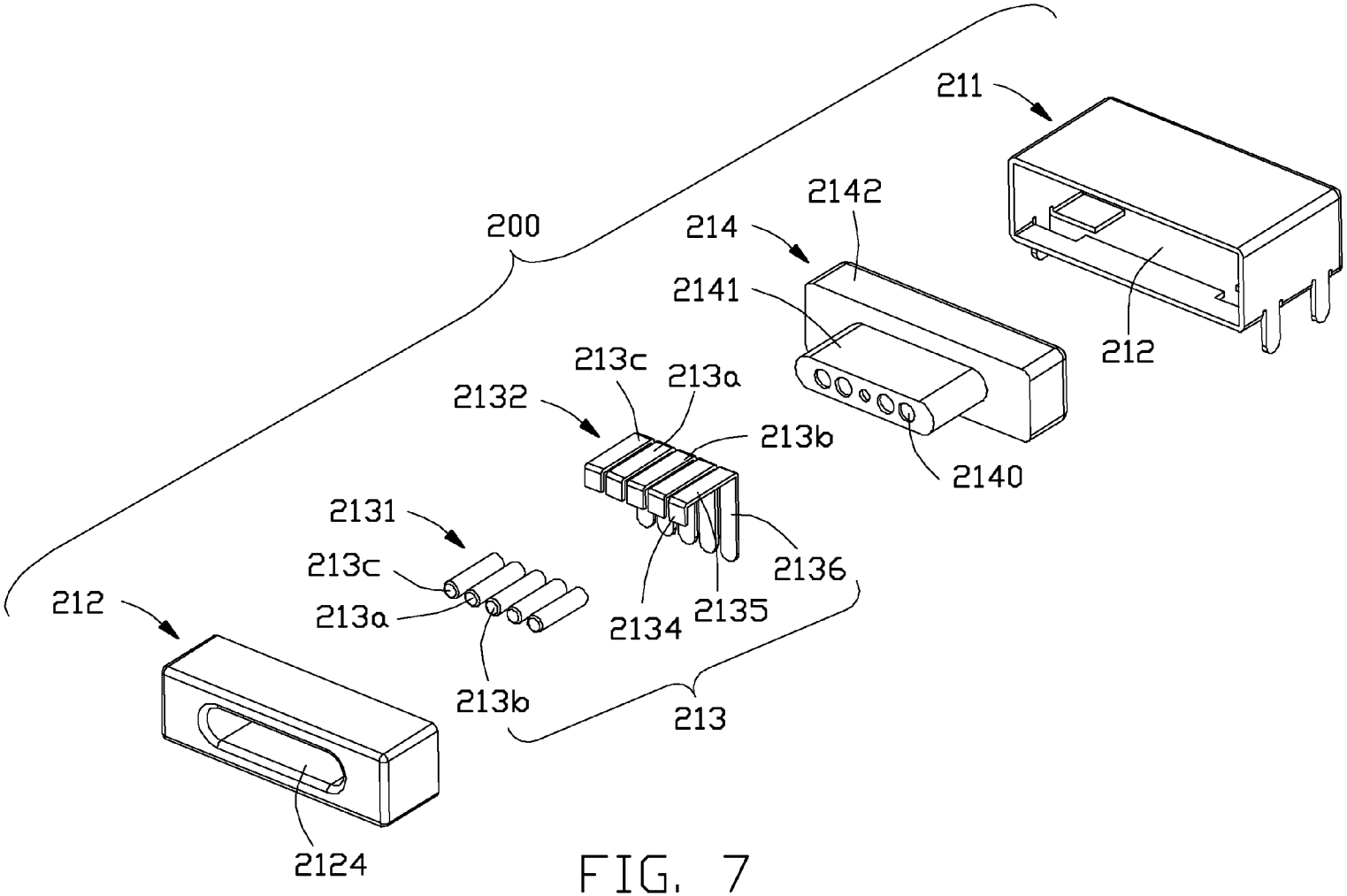
FIG. 7 is a perspective, exploded view of the second connector of the electrical connector assembly shown in FIG. 2.
Figure 8:
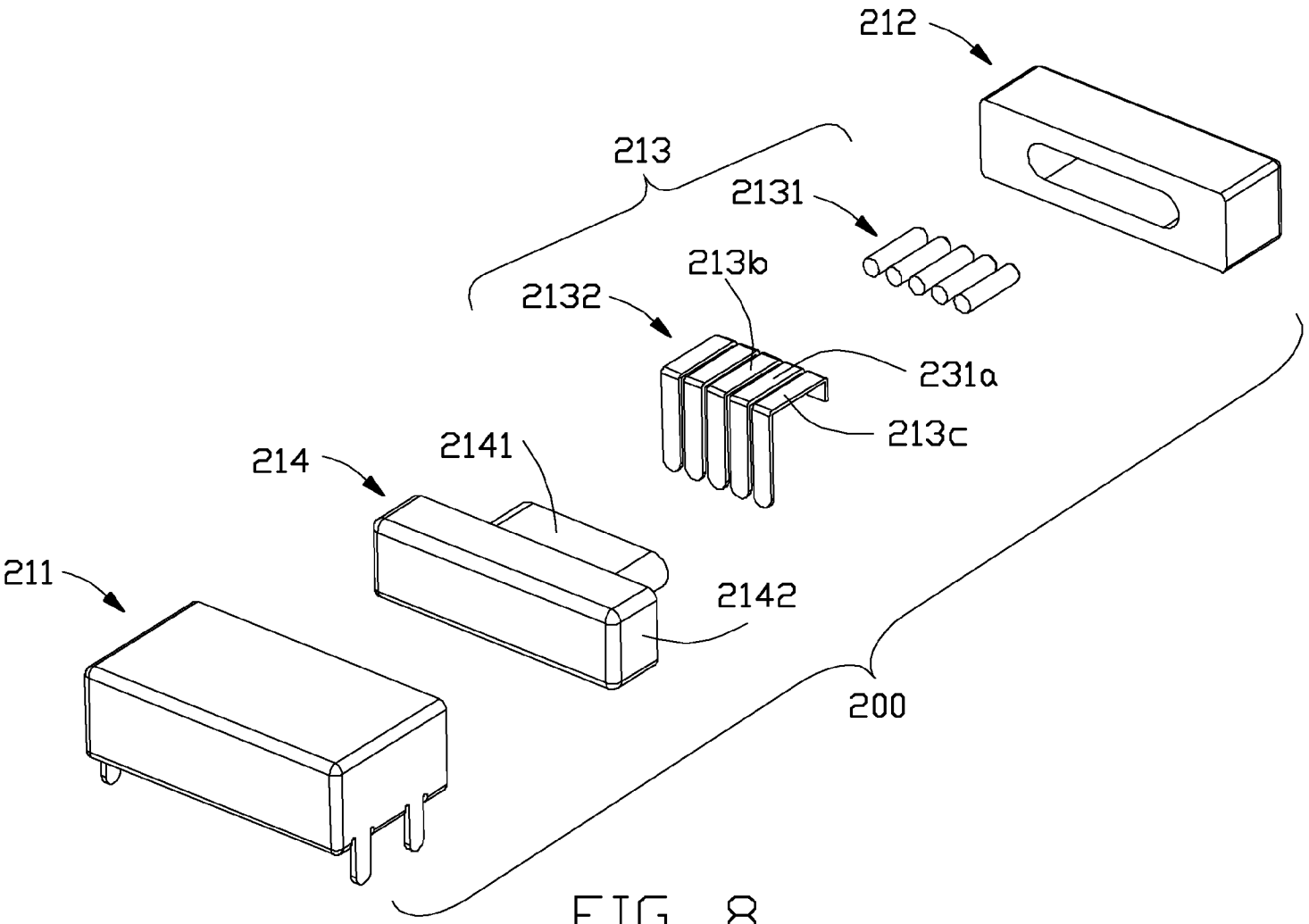
FIG. 8 is a perspective, exploded view of the second connector of the electrical connector assembly taken from a different view shown in FIG. 7.
Figure 9:
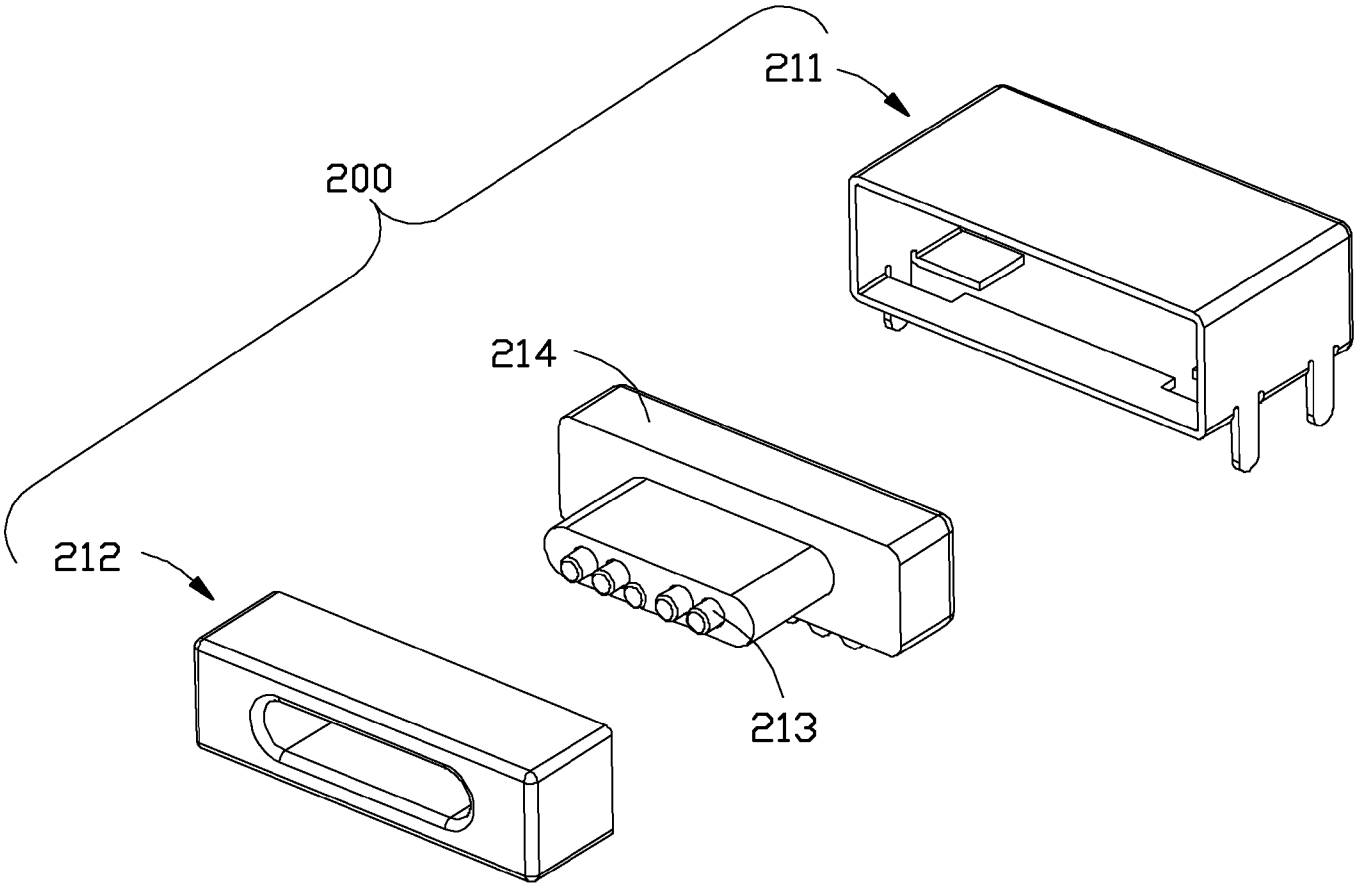
FIG. 9 is a perspective, partially assembled view of the second connector of the electrical connector assembly shown in FIG. 7.
Figure 10:
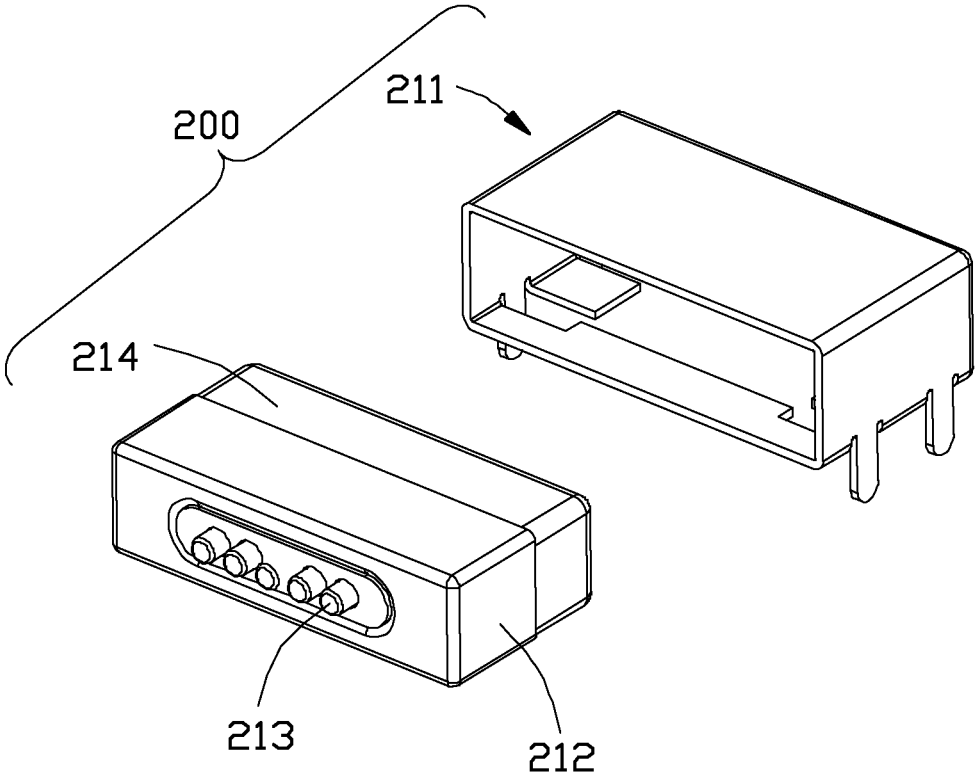
FIG. 10 is a perspective, further assembled view of the second connector of the electrical connector assembly shown in FIG. 8.

Referring to FIGS. 1-10, an electrical connector assembly 1000 in accordance with the first embodiment of the present invention is disclosed. Referring to FIGS. 1 to 2, an electrical connector assembly 1000 of the present embodiment comprises a first connector 100, a second connector 200, a printed circuit board 230 and a panel 220 located at a front end of the second connector 200 for protecting the second connector 200. The panel 220 defines a port 2201.

Referring to FIGS. 3 to 6, the first connector 100 comprises a plurality of first contacts 113 arranged along the transverse direction, a first spacer/housing 114 accommodating the first contacts 113, a first magnetic element 112 assembled to the first spacer 114, a printed circuit board 115 connecting with the first contacts 113 electrically, a cable 130 connecting with the printed circuit board 115 and a cover 120 assembled to a rear end of the first magnetic element 112 and a front end of the cable 130. The first magnetic element 112 defines a cavity 1121, and the first contacts 113 and the first spacer 114 are accommodated in the cavity 1121.

The first contacts 113 are retractable, and comprise a first signal contact 113*b*, a pair of first power contacts 113*a* located at two sides of the first signal contact 113*b*, and a pair of first grounding contacts 113*c* located at two sides of the pair of first power contacts 113*a*.

The first spacer 114 is made of plastic material, and comprises a main portion 1141 and a rear portion 1142 extending rearwardly from the main portion 1141. The rear portion 1142 is wider than the main portion 1141. The first spacer 114 defines a plurality of grooves 1140 extending through the main portion 1141 and the rear portion 1142 and receiving the first contacts 113. A front surface of the first contact 113 reach out of the grooves 1140.

The first magnetic element 112 surrounds the main portion 1141 and defines a receiving chamber 1121 extending through a front surface and a rear surface thereof.

In assembly, the first contact 113 is assembled to the first spacer 114 with the front surface of the contact 113 exceeding a front end of the first spacer 114. The first magnetic element 112 is assembled to the main portion 1141 of the first spacer 114 with the front surface of the contact 113 not exceeding a front end of the first magnetic element 112. The first contact 113 and the cable 130 are assembled to the printed circuit board 115 electrically. The cover 120 is assembled to the rear end of the first magnetic element 112 and the front end of the cable 130.

Referring to FIGS. 7 to 10, the second connector 200 comprises a plurality of second contacts 213, a second spacer 214 receiving the second contacts 213, a second magnetic element 212 assembled to the second spacer 214, a second metal shell 211 assembled to the second magnetic element 212. The second magnetic element 212 can attract the first magnetic element 112. The second contacts 213 are accommodated to the second magnetic element 212. A front surface of the second contact 213 exceed a front surface of the second magnetic element 212.

The second contacts 213 are unretractable, and comprise a second signal contact 213*b*, a pair of second power contacts 213*a* located at two sides of the second signal contact 213*b*, and a pair of second grounding contacts 213*c* located at two sides of the pair of second power contacts 213*a*. Each second contact 213 comprises a front contact 2131 and a rear contact 2132. The front contact 2131 and the rear contact 2132 are unretractable. The rear contact 2132 comprises a holding portion 2135, a mating portion 2134 bent forwardly from the holding portion 2135 and mating with the first connector 100, and a connecting portion 2136 bent rearwardly from the holding portion 2135 and connected with the printed circuit board 230 electrically. The mating portion 2134 and the connecting portion 2136 are perpendicular to the holding portion 2135 respectively. A rear surface of the front contact 2131 resist against a front surface of the rear contact 2132.

The second spacer 214 is made of plastic material, and comprises a main portion 2141 and a rear portion 2142 extending rearwardly from the main portion 2141. The rear portion 2142 is wider than the main portion 2141. The second spacer 214 defines a plurality of grooves 2140 extending through the main portion 2141 and the rear portion 2142 and receiving the second contacts 213. The front contact 2131 reach out the grooves 2140. The second magnetic element 212 surrounds the main portion 2141 and defines a receiving chamber 2124 extending through a front surface and a rear surface thereof. The second metal shell 211 surrounds the second magnetic element 212 and defines a receiving space 2112 receiving the second magnetic element 212 and the second spacer 214.

In assembly, the second contact 213 is assembled to the second spacer 214. The second magnetic element 212 is assembled to the main portion 2141 of the second spacer 214. The front surface of the second contacts 213 exceeds a front surface of the second spacer 214 and the second magnetic element 212. At last, the second metal shell 211 is assembled to the second magnetic element 212 and the second spacer 214. The front surface of the second contacts 213 does not exceed a front surface of the panel 220 for protecting the second contacts 213.

The panel 220 defines an asymmetric port in the up-to-down direction thereof. The first connector 100 comprises a mating section. The periphery of the mating section corresponds to the port 2201 of the panel 220, so that the mating section can enter into the port 2201 along a single direction. In the embodiment, the periphery of the mating section is the periphery of the first magnetic element 112. In another embodiment, the panel defines an asymmetric port in the left-to-right direction thereof, and the periphery of the mating section corresponds to the port 2201 of the panel 220, so that the mating section can enter into the port 2201 along a single direction.

When the first connector 100 enters into the second connector 200 in a right way, the first magnetic element 112 of the first connector 100 can enter into the second connector 200 along the port 2201 of the panel 220 and mates with the second connector 200. When the first connector 100 enters into the second connector 200 in a wrong way, the first magnetic element 112 of the first connector 100 can not enter into the port 2201 and then can not mate with the second connector 200.

The first magnetic element 112 includes a "N" pole and a "S" pole located at two ends thereof along a mating direction of the first magnetic element 112 and the second magnetic element 212. The second magnetic element 212 includes a "S" pole and a "N" pole located at two sides thereof along the corresponding direction. When the first connector 100 mates with the second connector 200, the "S" pole of the first magnetic element 112 attracts at the "N" pole of the second magnetic element 212. The poles of the corresponding ends of the first magnetic element 112 and the second magnetic element 212 are opposite and attract each other, so that the first connector 100 succeeds in mating with the second connector 200.

Figure 11:
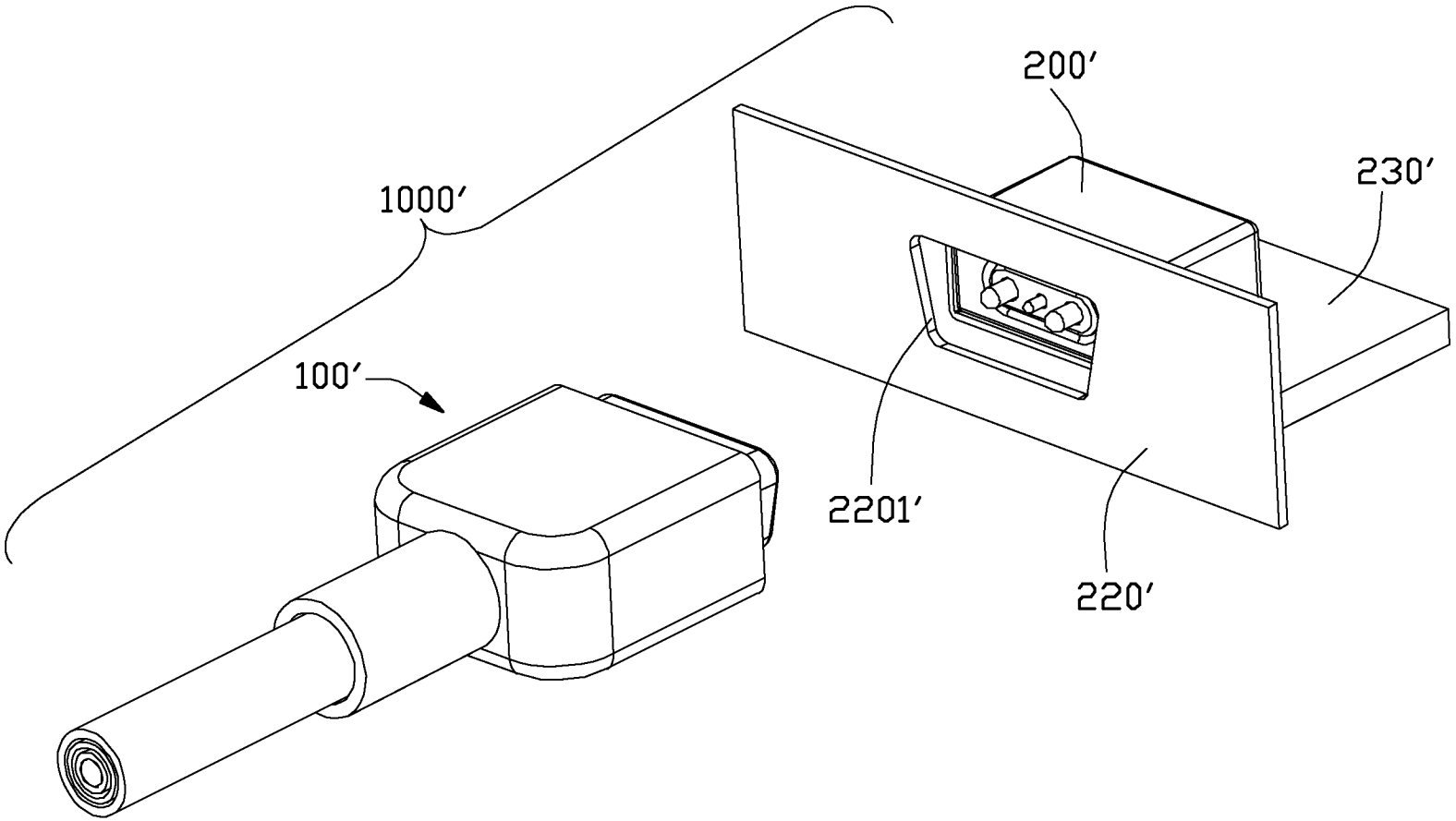
FIG. 11 is a perspective, assembled view of an electrical connector assembly when a first connector is not mated with a second connector in accordance with the second embodiment of the present invention.
Figure 12:
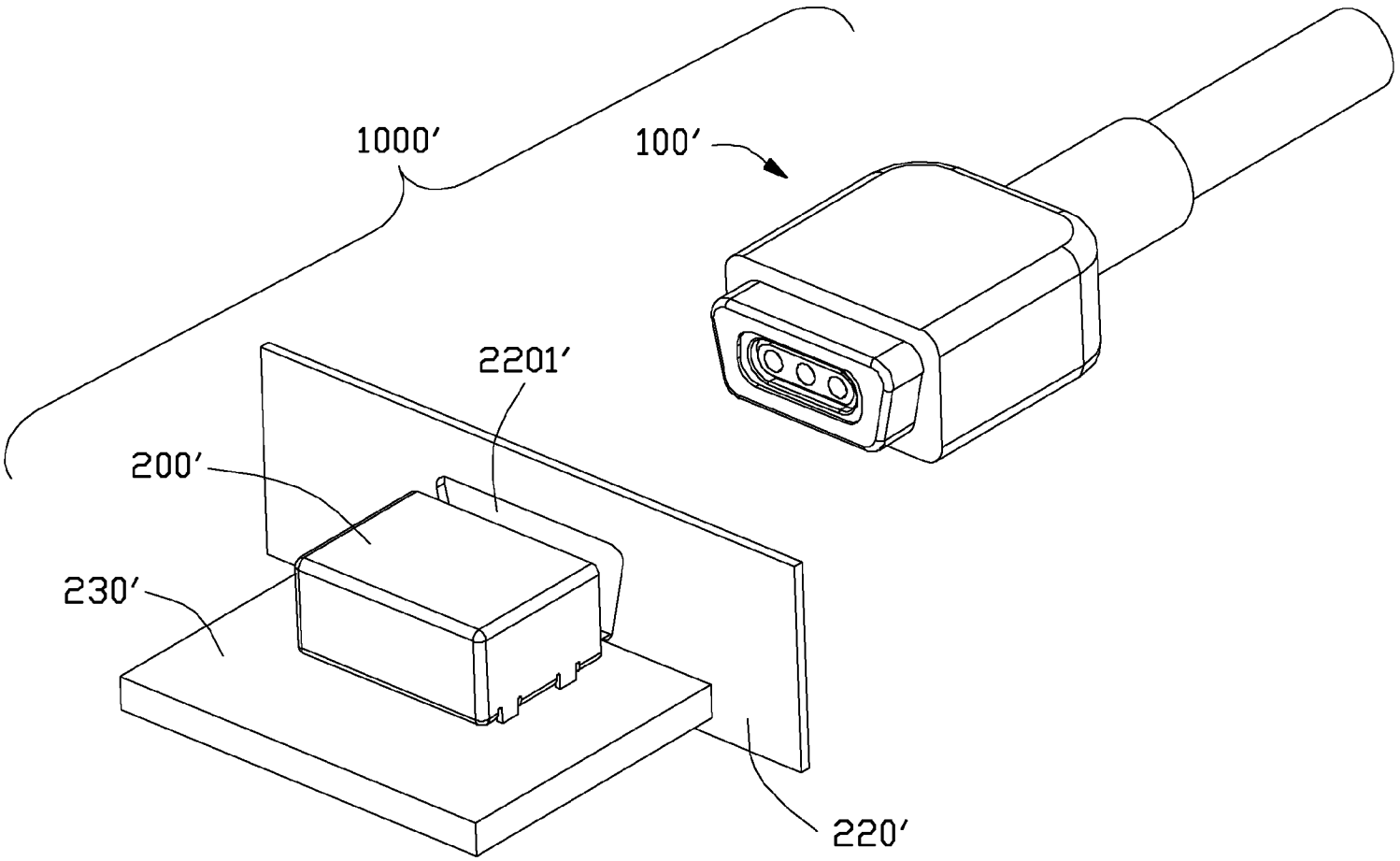
FIG. 12 is a perspective, assembled view of the electrical connector assembly, taken from a different view shown in FIG. 11.
Figure 13:
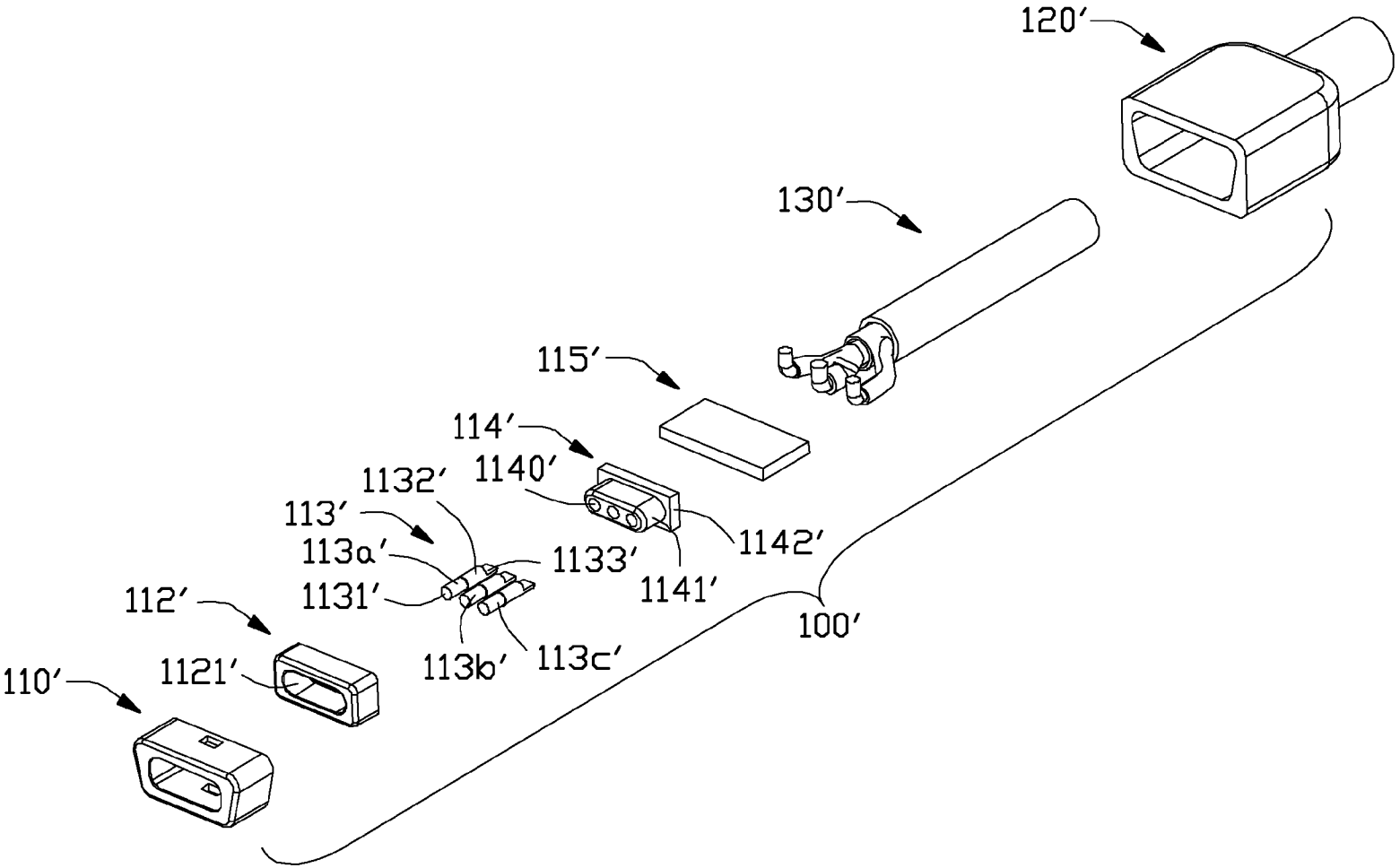
FIG. 13 is a perspective, exploded view of the first connector of the electrical connector assembly shown in FIG. 12.
Figure 14:
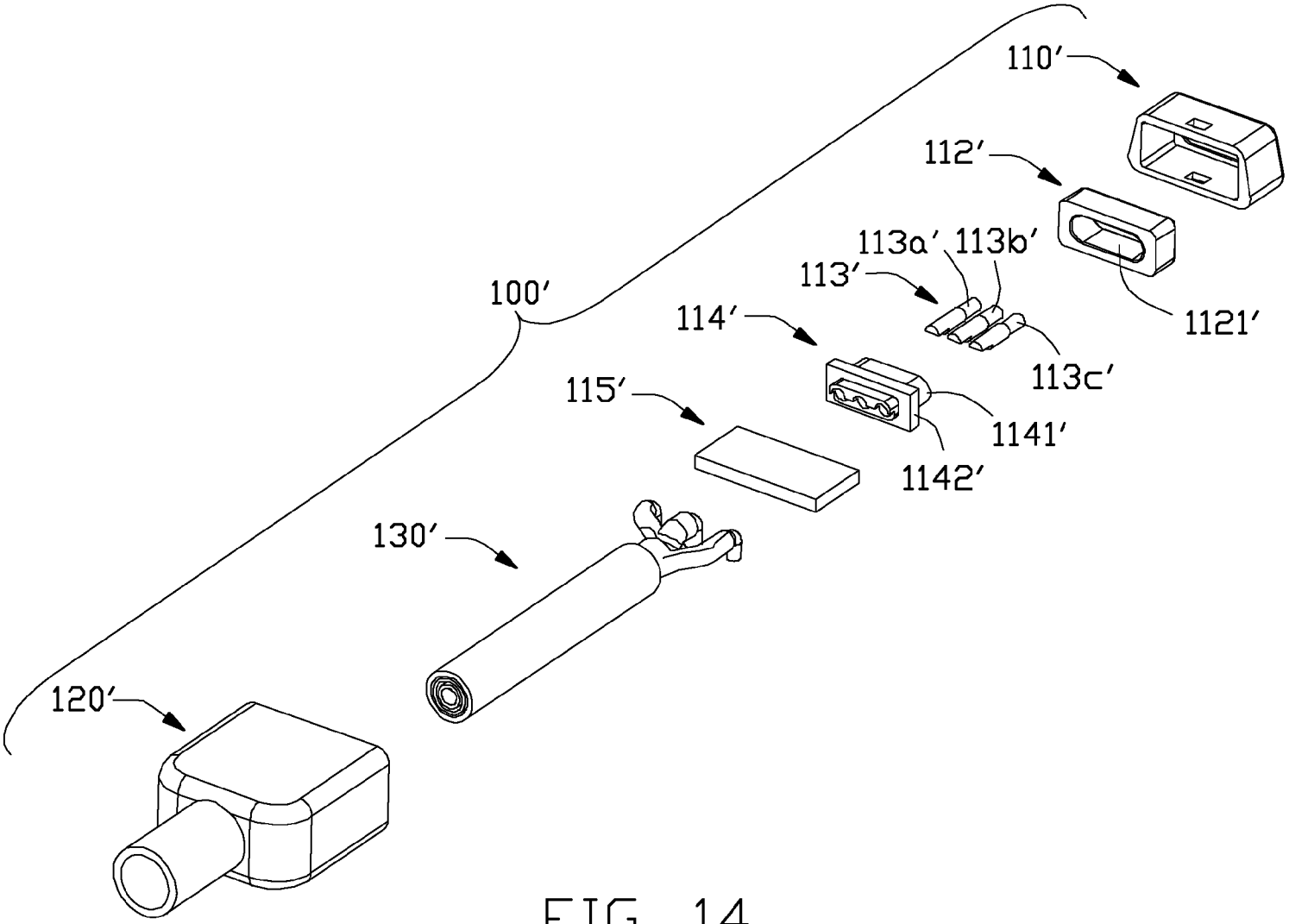
FIG. 14 is a perspective, exploded view of the first connector taken from a different view shown in FIG. 13.
Figure 15:
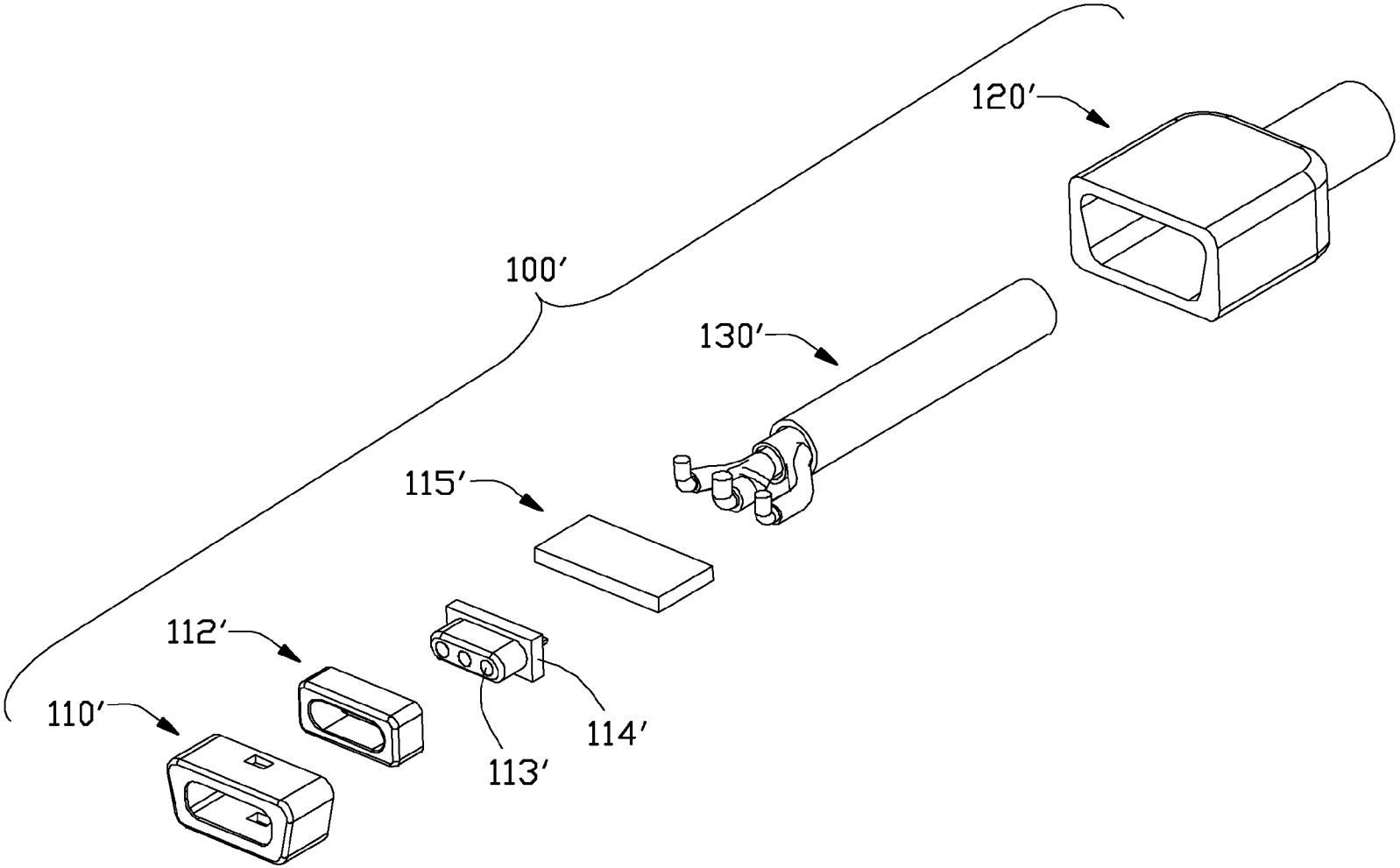
FIG. 15 is a perspective, partially assembled view of the first connector shown in FIG. 13.
Figure 16:
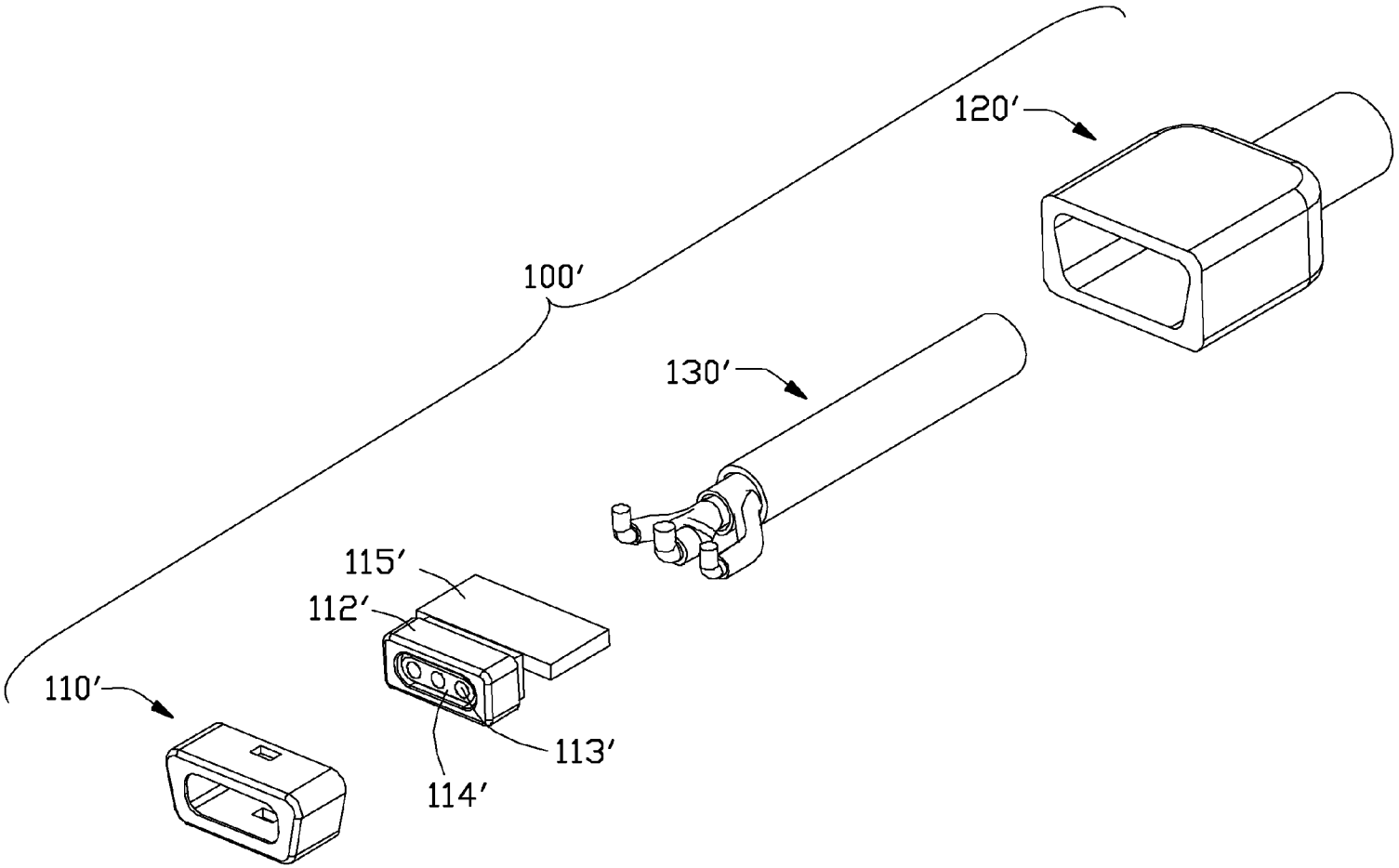
FIG. 16 is a perspective, further assembled view of the first connector shown in FIG. 15.
Figure 17:
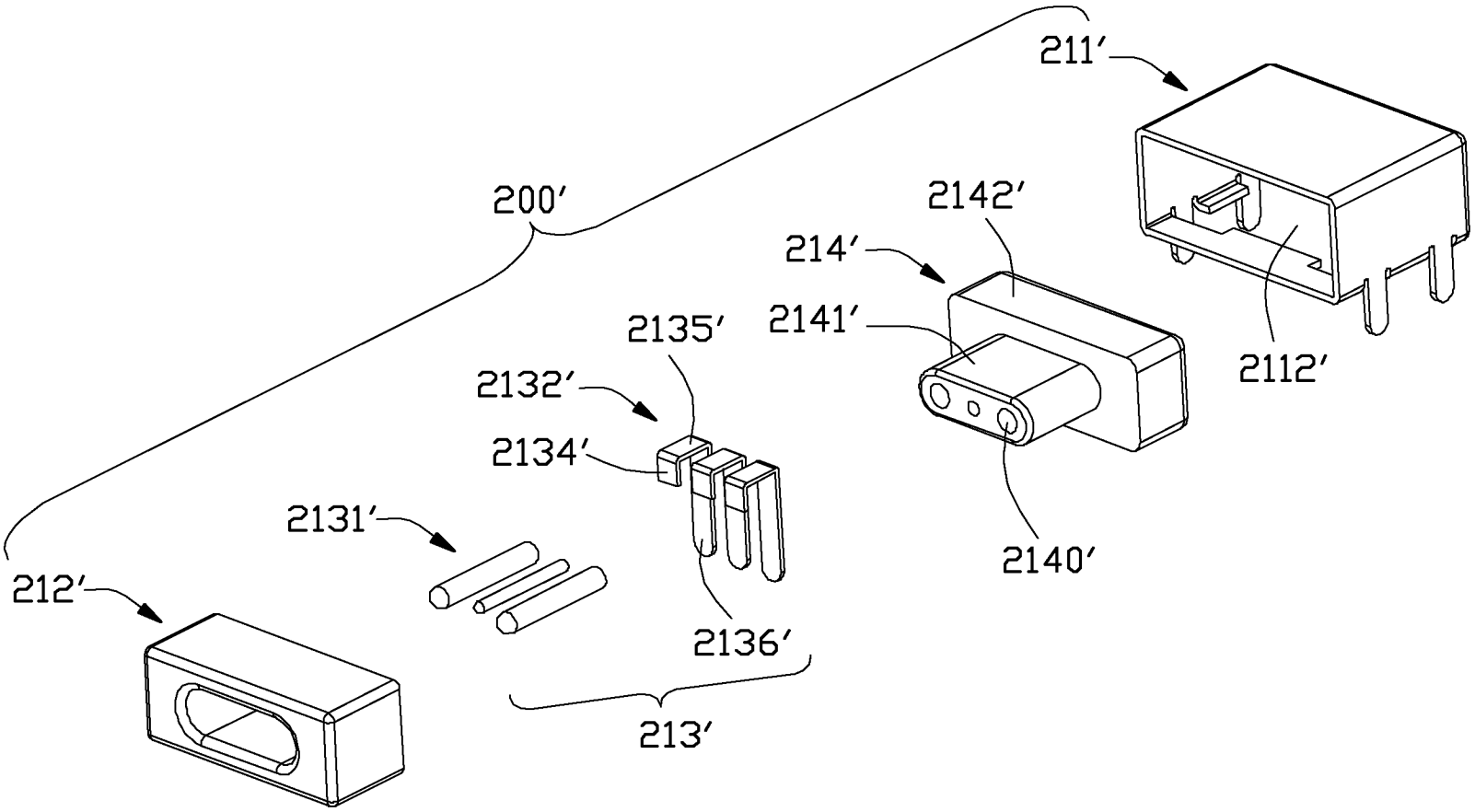
FIG. 17 is a perspective, exploded view of the second connector of the electrical connector assembly shown in FIG. 11.
Figure 18:
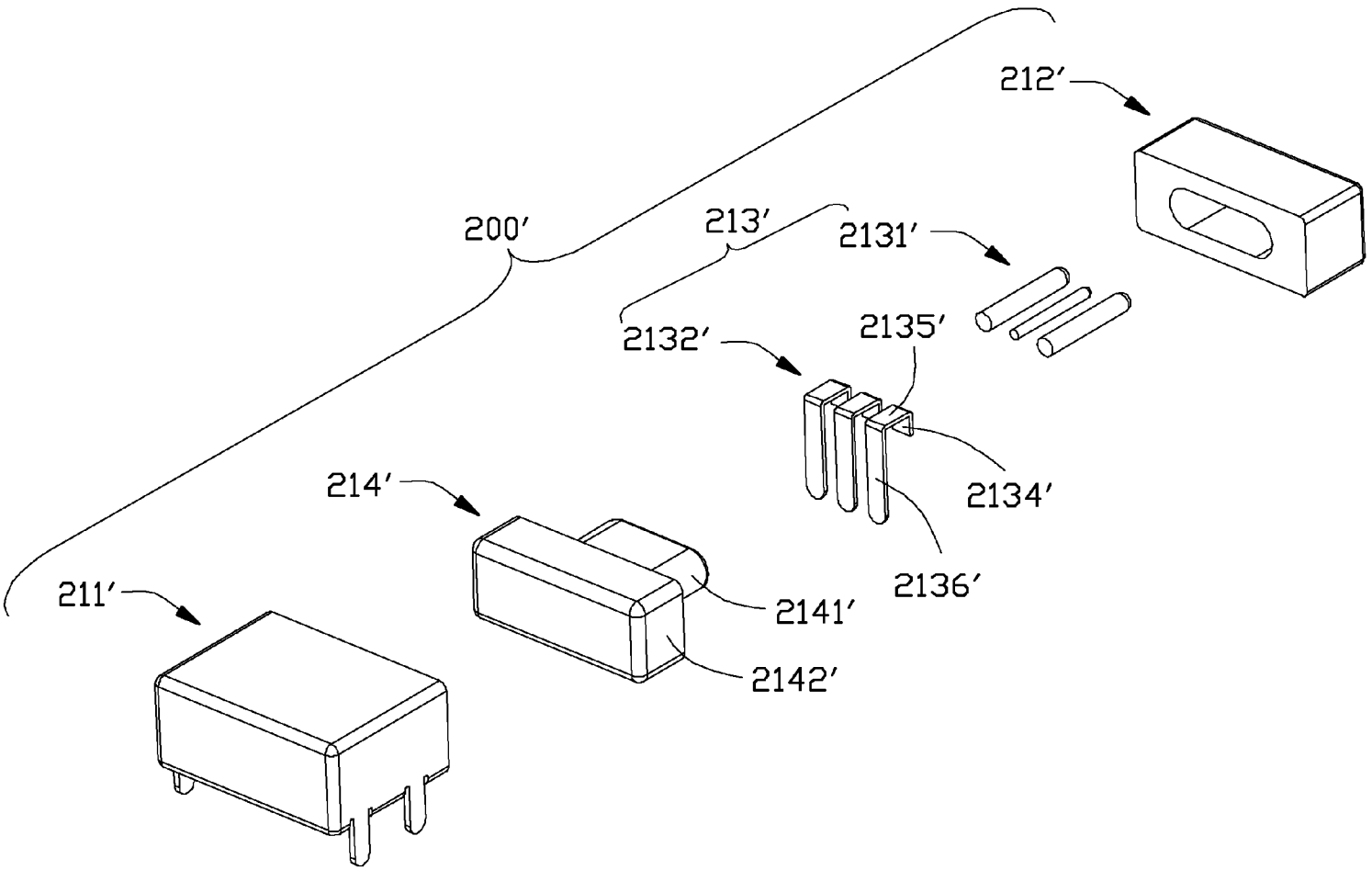
FIG. 18 is a perspective, exploded view of the second connector of the electrical connector assembly taken from a different view shown in FIG. 17.
Figure 19:
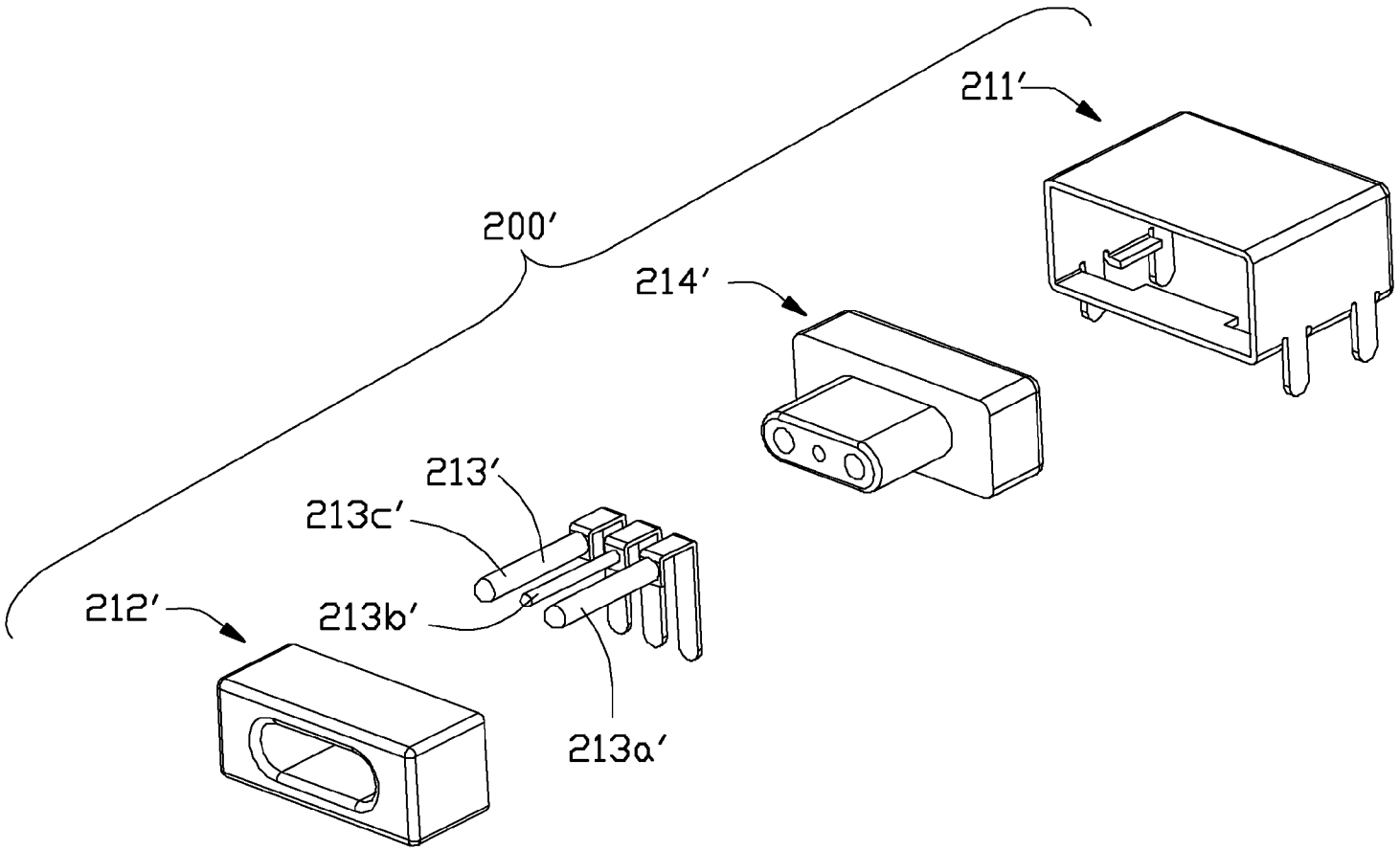
FIG. 19 is a perspective, partially assembled view of the second connector of the electrical connector assembly shown in FIG. 17.
Figure 20:
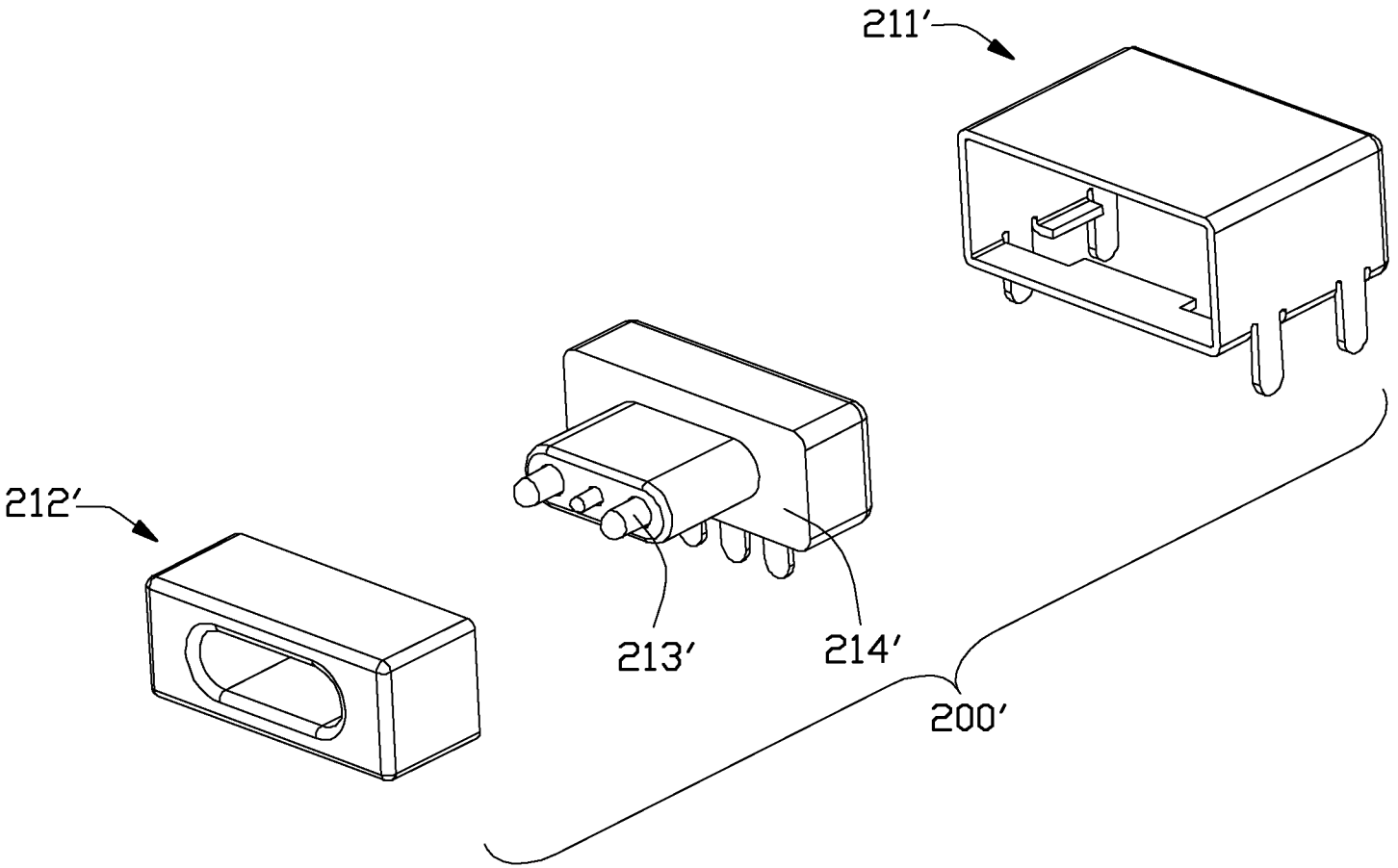
FIG. 20 is a perspective, further assembled view of the second connector of the electrical connector assembly shown in FIG. 19.
Figure 21:
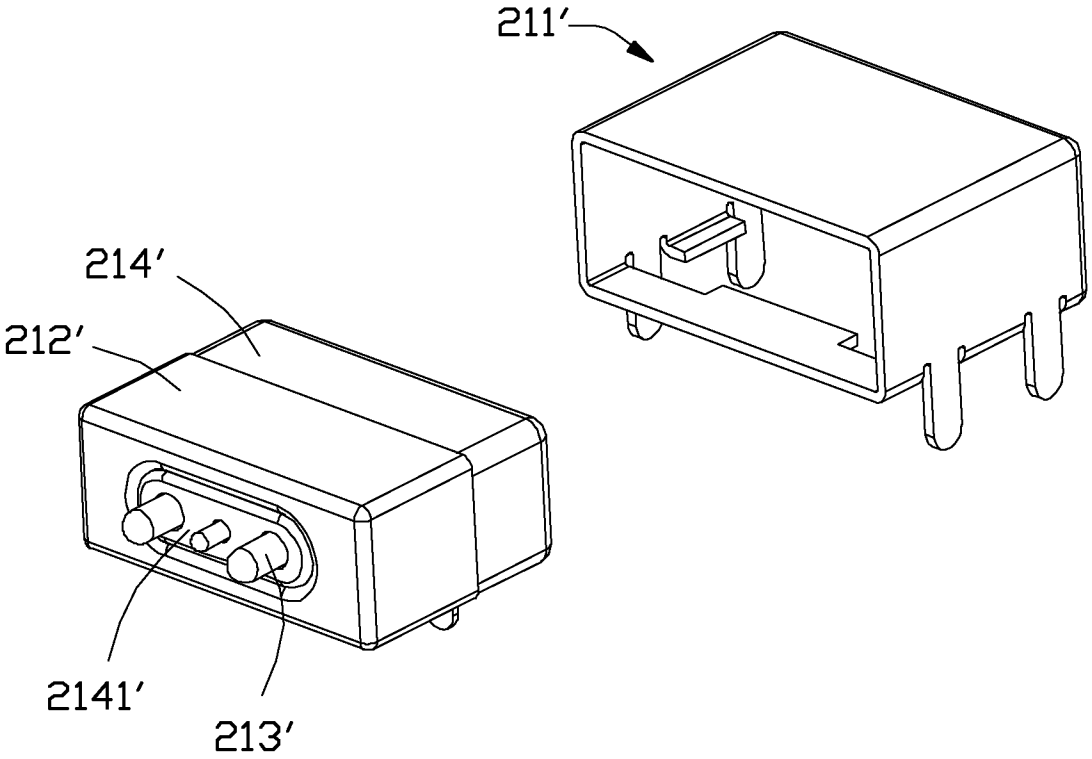
FIG. 21 is a perspective, further assembled view of the second connector of the electrical connector assembly shown in FIG. 20.

Referring to FIGS. 11-21, an electrical connector assembly 1000' in accordance with the second embodiment of the present invention is disclosed. Referring to FIGS. 11 to 12, an electrical connector assembly 1000' of the present embodiment comprises a first connector 100', a second connector 200' and a printed circuit board 230'.

Referring to FIGS. 13 to 16, the first connector 100' comprises a plurality of first contacts 113' arranged along the transverse direction, a first spacer 114' accommodating the first contacts 113', a first magnetic element 112' assembled to the first spacer 114', a first metal shell 110' assembled to the first magnetic element 112', a printed circuit board 115' connecting with the first contacts 113' electrically, a cable 130' connecting with the printed circuit board 115' and a cover 120' assembled to a rear end of the first metal shell 110' and a front end of the cable 130'. The first magnetic element 112' defines a cavity 1121', and the first contacts 113' and the first spacer 114' are accommodated in the cavity 1121'.

The first contacts 113' are unretractable, and comprise a first power contact 113*a*', a first grounding contact 113*c*' and a first signal contact 113*b*' located between the first power contact 113*a*' and the first grounding contact 113*c*'. Each first contact 113' comprises a mating portion 1131' mating with the second connector 200' electrically, a holding portion 1132' extending rearwardly from the mating portion 1131' and fixing the first contact 113', and a connecting portion 1133' extending rearwardly from the holding portion 1132' and connected with the printed circuit board 115'. The holding portion 1132' is thicker than the mating portion 1131' and the connecting portion 1133'.

The first spacer 114' is made of plastic material, and comprises a main portion 1141' and a rear portion 1142' extending rearwardly from the main portion 1141'. The rear portion 1142' is wider than the main portion 1141'. The first spacer 114' defines a plurality of grooves 1140' extending through the main portion 1141' and the rear portion 1142' and receiving the first contacts 113'. The mating portions 1131' of the first contacts 113' do not exceed the grooves 1140'.

The first magnetic element 112' surrounds the main portion 1141' and defines a receiving chamber 1121' extending through a front surface and a rear surface thereof. The first metal shell 110' surrounds the first magnetic element 112' and defines a receiving space 1101' receiving the first magnetic element 112' and the first spacer 114'. The port 2201' is an asymmetric port in an up-to-down direction of the panel 220'. The periphery of the first metal shell 110' corresponds to the port 2201' of the panel 220', so that the first metal shell 110' can enter into the port 2201' of the panel 220' along a single direction. In present embodiment, the periphery of the first metal shell 110' and the port 2201' are trapezidal respectively. In another embodiment, the port 2201' is an asymmetric port in a left-to-down direction of the panel 220'. The periphery of the first metal shell 110' is asymmetric in the left-to-down direction corresponding to the port 2201', so that the first metal shell 110' can enter into the port 2201' of the panel 220' along a single direction.

In assembly, the first contact 113' is assembled to the first spacer 114'. The first magnetic element 112' is assembled to the main portion 1141' of the first spacer 114'. The front surface of the first contacts 113' does not exceed a front surface of the first spacer 114' and the first magnetic element 112'. The front surface of the first spacer 114' does not exceed the front surface of the first magnetic element 112'. The first contact 113' and the cable 130' are assembled to the printed circuit board 115' electrically. The first metal shell 110' is assembled to the first magnetic element 112' and the first spacer 114'. The front surface of the first magnetic element 112' does not exceed a front surface of the first metal shell 110'. The cover 120' is assembled to the rear end of the first metal shell 110' and the front end of the cable 130'.

Referring to FIGS. 17 to 21, the second connector 200' comprises a plurality of second contacts 213', a second spacer 214' receiving the second contacts 213', a second magnetic element 212' assembled to the second spacer 214', a second metal shell 211' assembled to the second magnetic element 212'. The second magnetic element 212' can attract the first magnetic element 112'. The second contacts 213' are accommodated to the second magnetic element 212'.

The second contacts 213' comprise a second power contact 213*a*', a second grounding contact 213*c*' and a second signal contact 213*b*' located between the second power contact 213*a*' and the second grounding contact 213*c*'. Each second contact 213' comprises a front contact 2131' and a rear contact 2132'. The front contact 2131' is an retractable and cylindrical contact. The rear contact 2132' is an unretractable contact, and comprises a holding portion 2135', a mating portion 2134' bent forwardly from the holding portion 2135' and mating with the first connector 100', and a connecting portion 2136' bent rearwardly from the holding portion 2135' and connected with the printed circuit board 230' electrically. The mating portion 2134' and the connecting portion 2136' are perpendicular to the holding portion 2135' respectively. A rear surface of the front contact 2131' resist against a front surface of the rear contact 2132'.

The second spacer 214' is made of plastic material, and comprises a main portion 2141' and a rear portion 2142' extending rearwardly from the main portion 2141. The rear portion 2142' is wider than the main portion 2141'. The second spacer 214' defines a plurality of grooves 2140' extending through the main portion 2141' and the rear portion 2142' and receiving the second contacts 213'. The front contact 2131' reach out the grooves 2140'. The second magnetic element 212' surrounds the main portion 2141' and defines a receiving chamber 2124' extending through a front surface and a rear surface thereof. The second metal shell 211' surrounds the second magnetic element 212' and defines a receiving space 2112' receiving the second magnetic element 212' and the second spacer 214'.

In assembly, the second contact 213' is assembled to the second spacer 214'. The second magnetic element 212' is assembled to the main portion 2141' of the second spacer 214'. A front surface of the second contact 213' exceeds a front surface of the second spacer 214' and the second magnetic element 212'. At last, the second metal shell 211' is assembled to the second magnetic element 212' and the second spacer 214'. The front surface of the second contacts 213' does not exceed a front surface of the panel 220' for protecting the second contacts 213'.

The panel 220' defines an asymmetric port in the up-to-down direction thereof. The first connector 100' comprises a mating section. The periphery of the mating section corresponds to the port 2201' of the panel 220', so that the mating section can enter into the port 2201' along a single direction. In the embodiment, the periphery of the mating section is the periphery of the first metal shell 110'. In another embodiment, the panel defines an asymmetric port in the left-to-right direction thereof, and the periphery of the mating section corresponds to the port 2201' of the panel 220', so that the mating section can enter into the port 2201' along a single direction.

When the first connector 100' enters into the second connector 200' in a right way, the first metal shell 110' of the first connector 100' can enter into the second connector 200' along the port 2201' of the panel 220' and mates with the second connector 200'. When the first connector 100' enters into the second connector 200' in a wrong way, the first metal shell 110' of the first connector 100' can not enter into the port 2201' and then can not mate with the second connector 200'.

Figure 22:
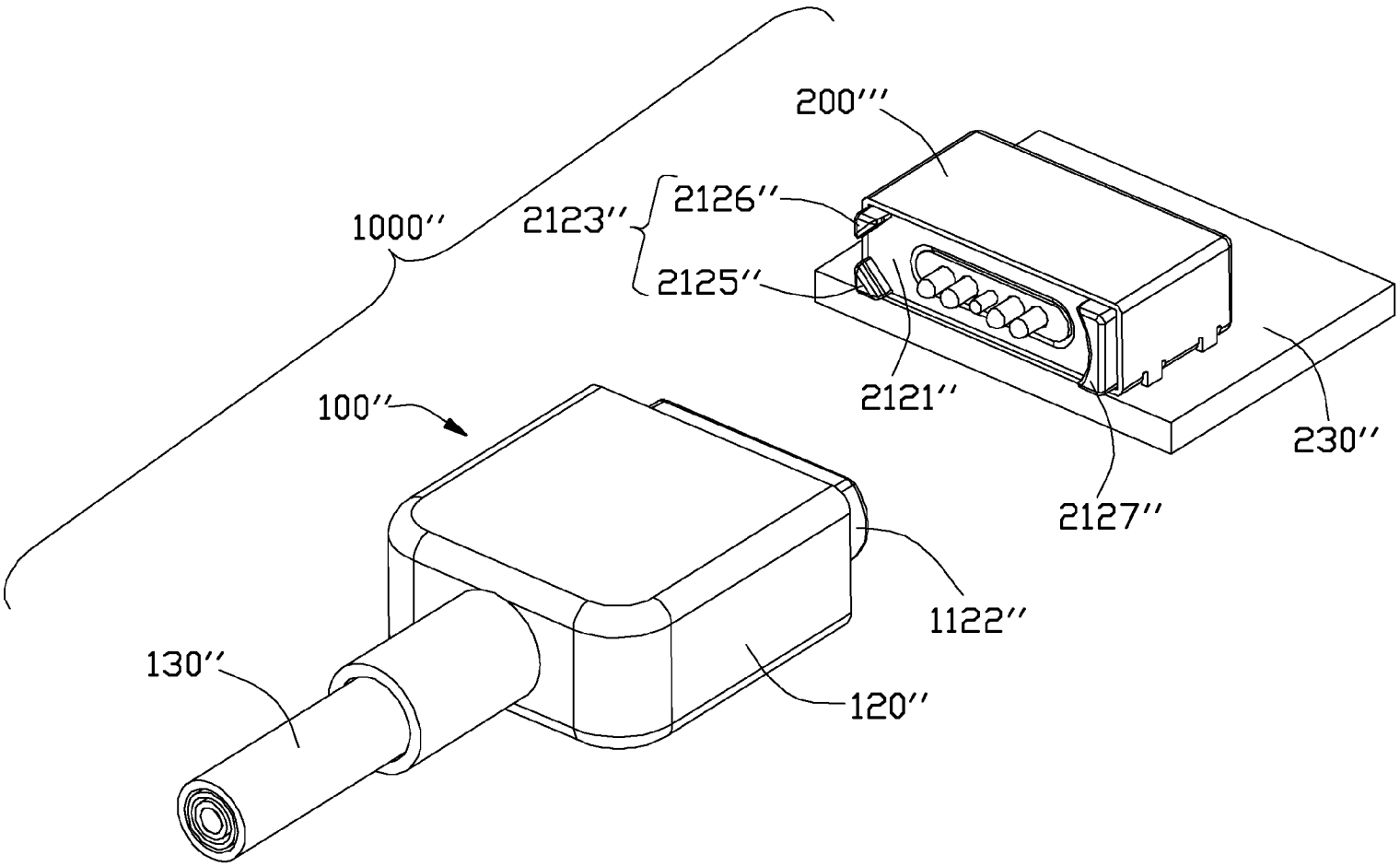
FIG. 22 is a perspective, assembled view of an electrical connector assembly when a first connector is not mated with a second connector in accordance with the third embodiment of the present invention.
Figure 23:
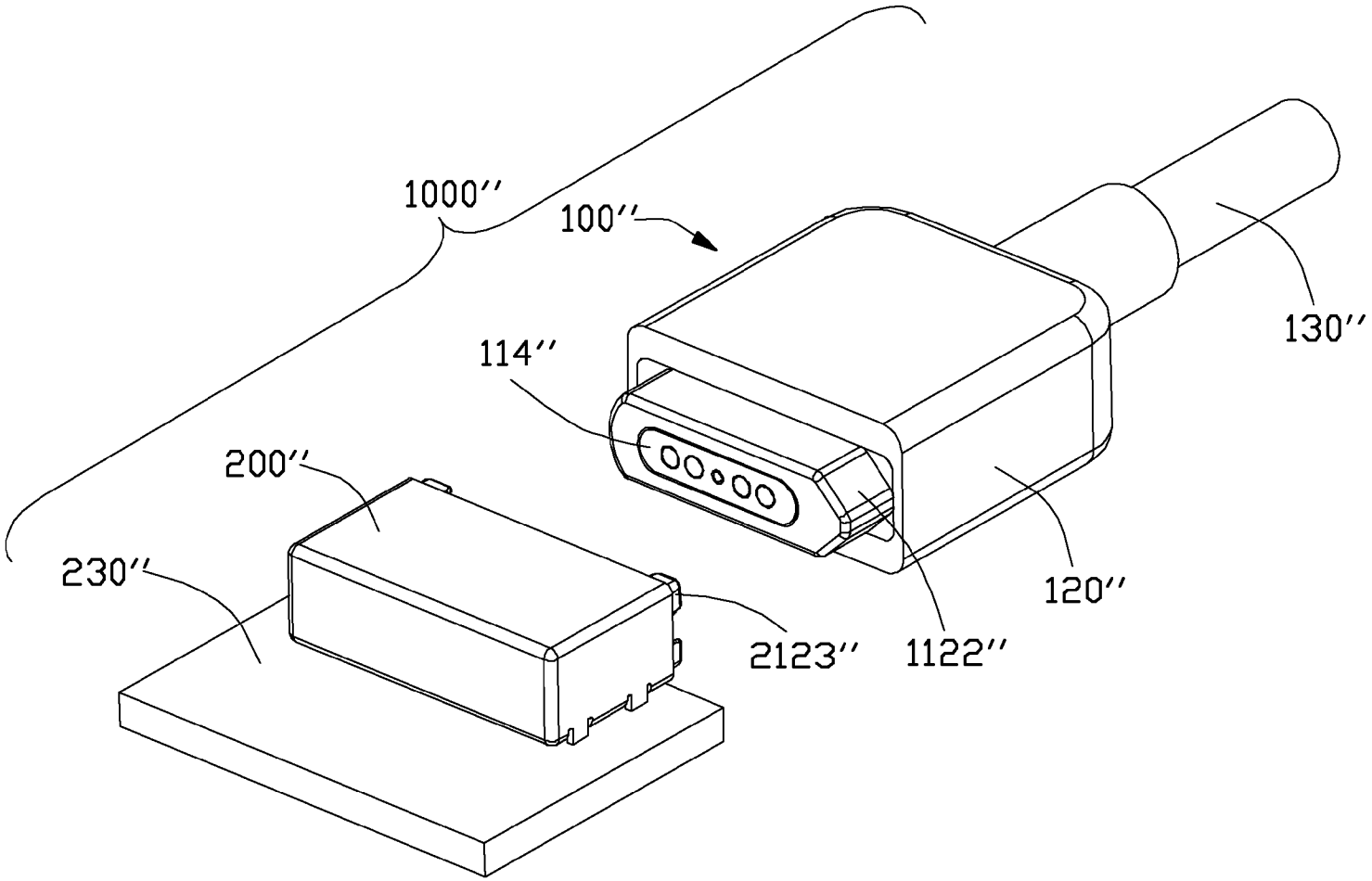
FIG. 23 is a perspective, assembled view of the electrical connector assembly, taken from a different view shown in FIG. 22.
Figure 24:
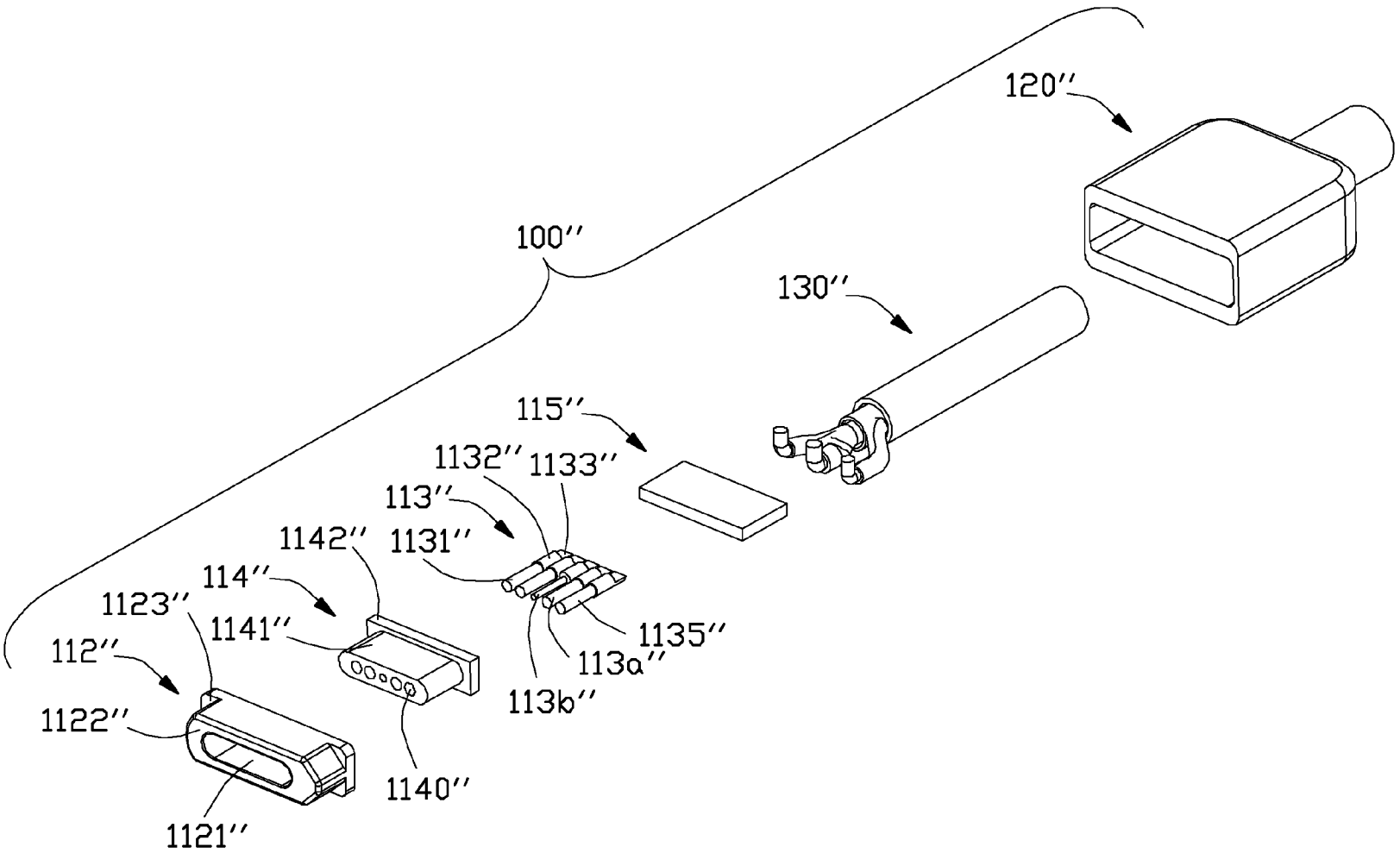
FIG. 24 is a perspective, exploded view of the first connector of the electrical connector assembly shown in FIG. 23.
Figure 25:
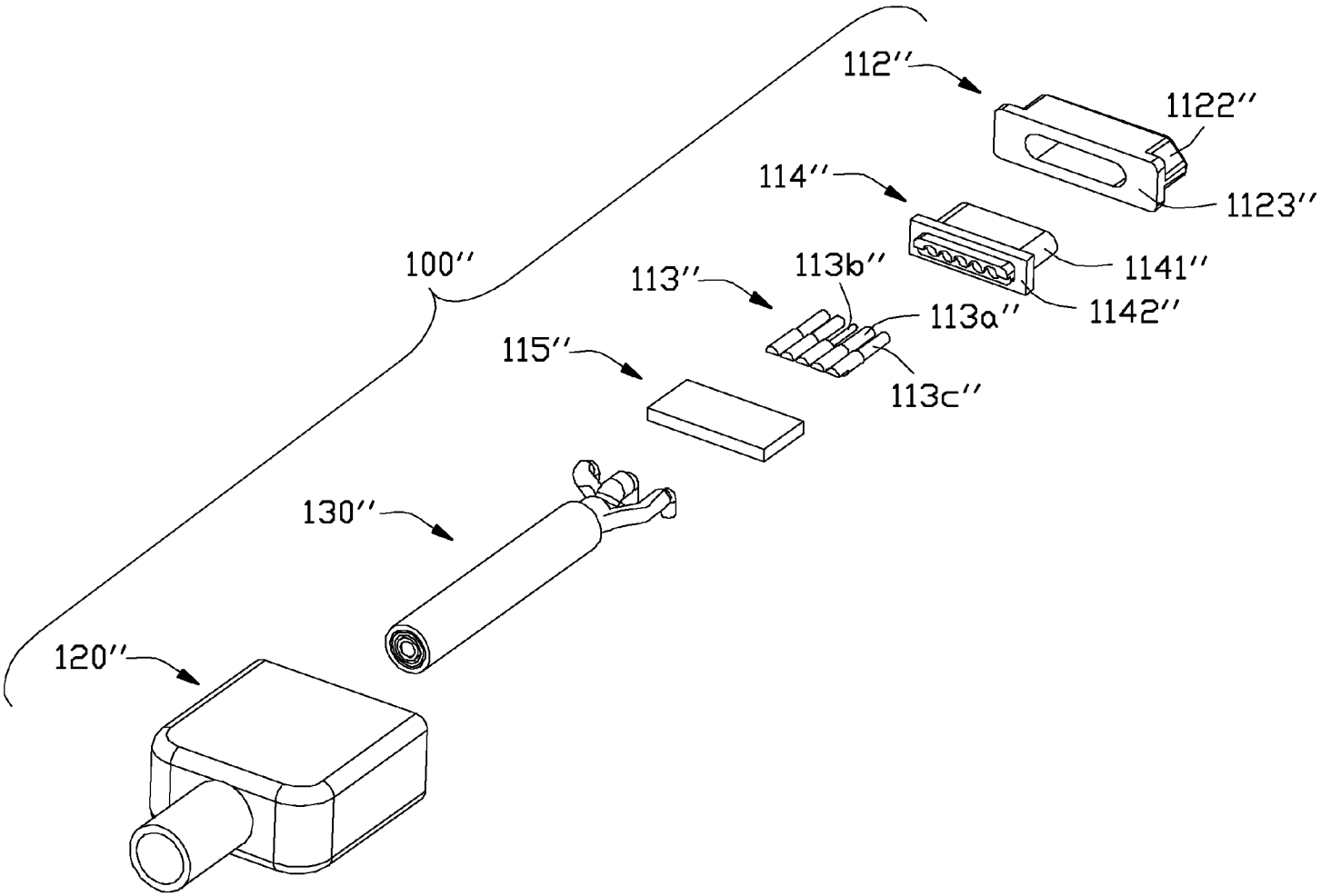
FIG. 25 is a perspective, exploded view of the first connector taken from a different view shown in FIG. 24.
Figure 26:
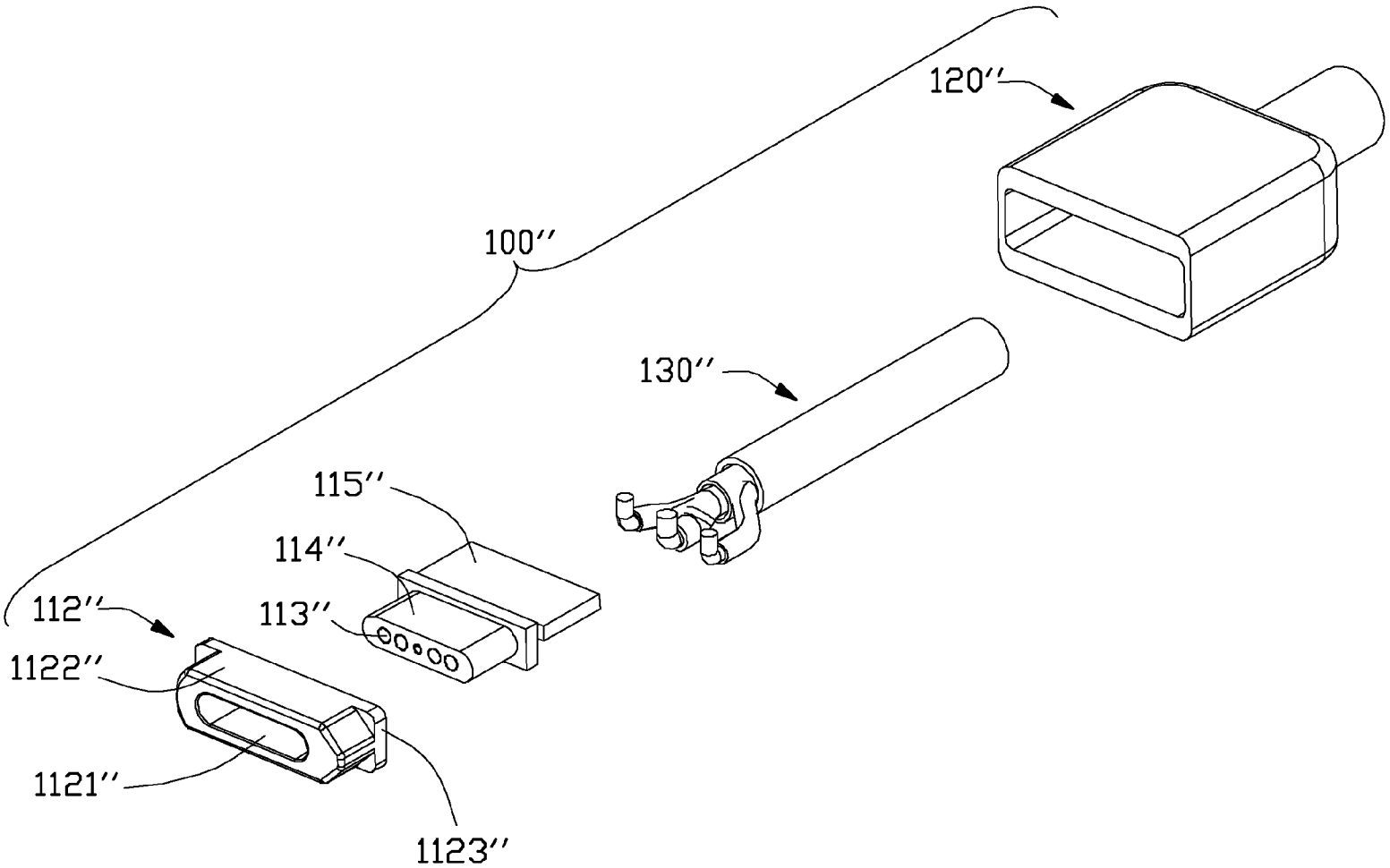
FIG. 26 is a perspective, partially assembled view of the first connector shown in FIG. 25.
Figure 27:
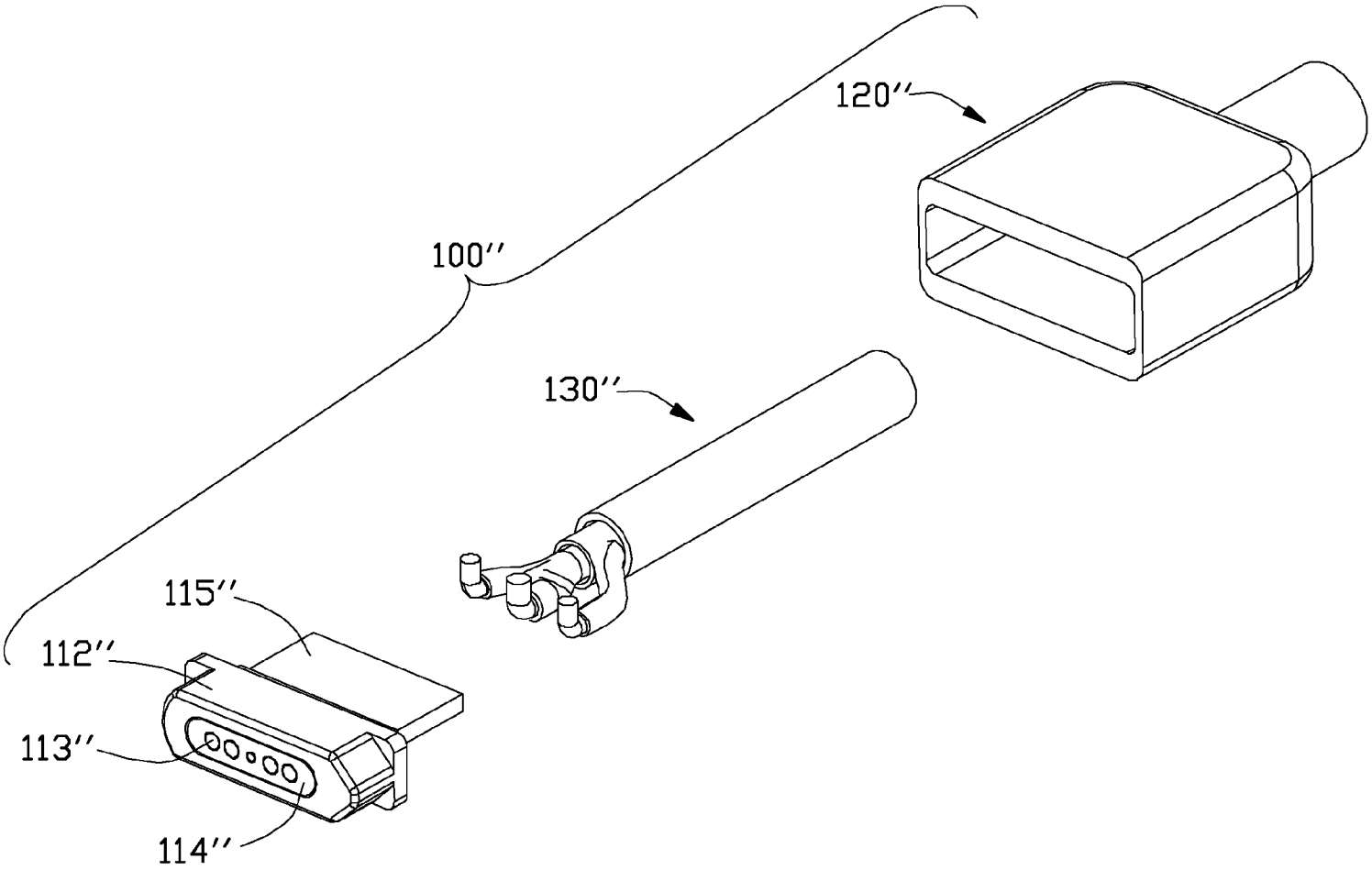
FIG. 27 is a perspective, further assembled view of the first connector shown in FIG. 26.
Figure 28:
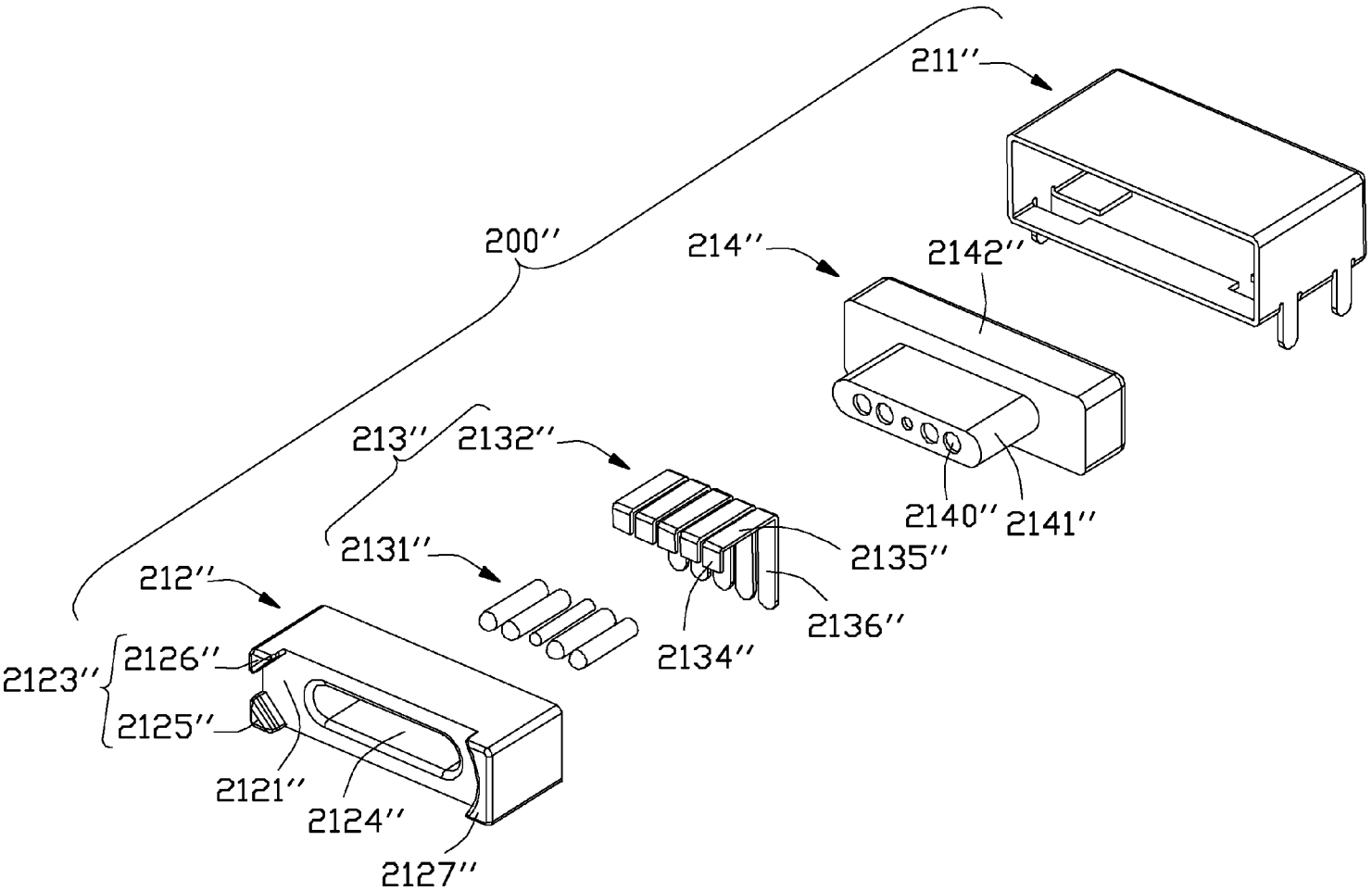
FIG. 28 is a perspective, exploded view of the second connector of the electrical connector assembly shown in FIG. 22.
Figure 29:
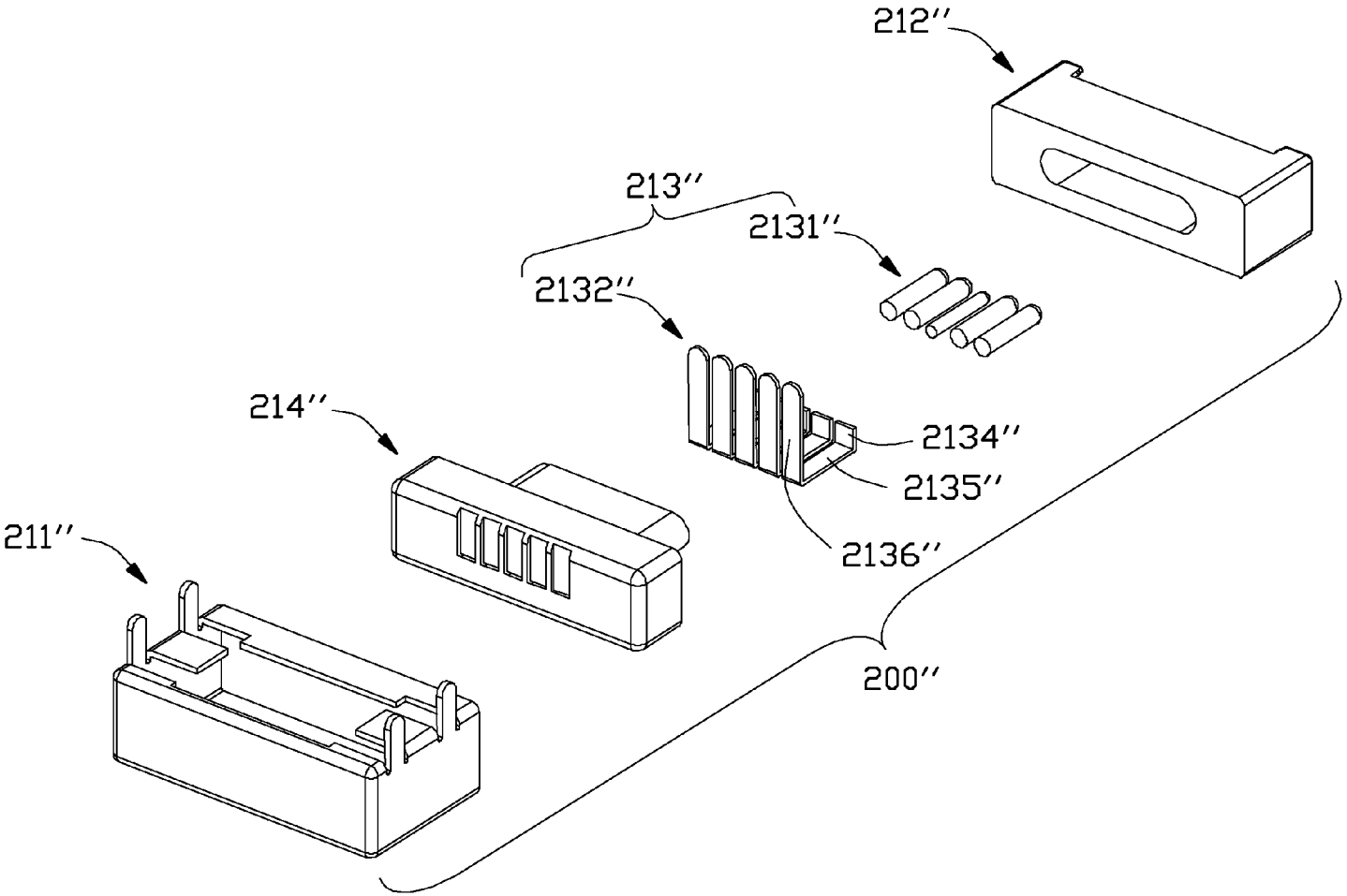
FIG. 29 is a perspective, exploded view of the second connector of the electrical connector assembly taken from a different view shown in FIG. 28.
Figure 30:
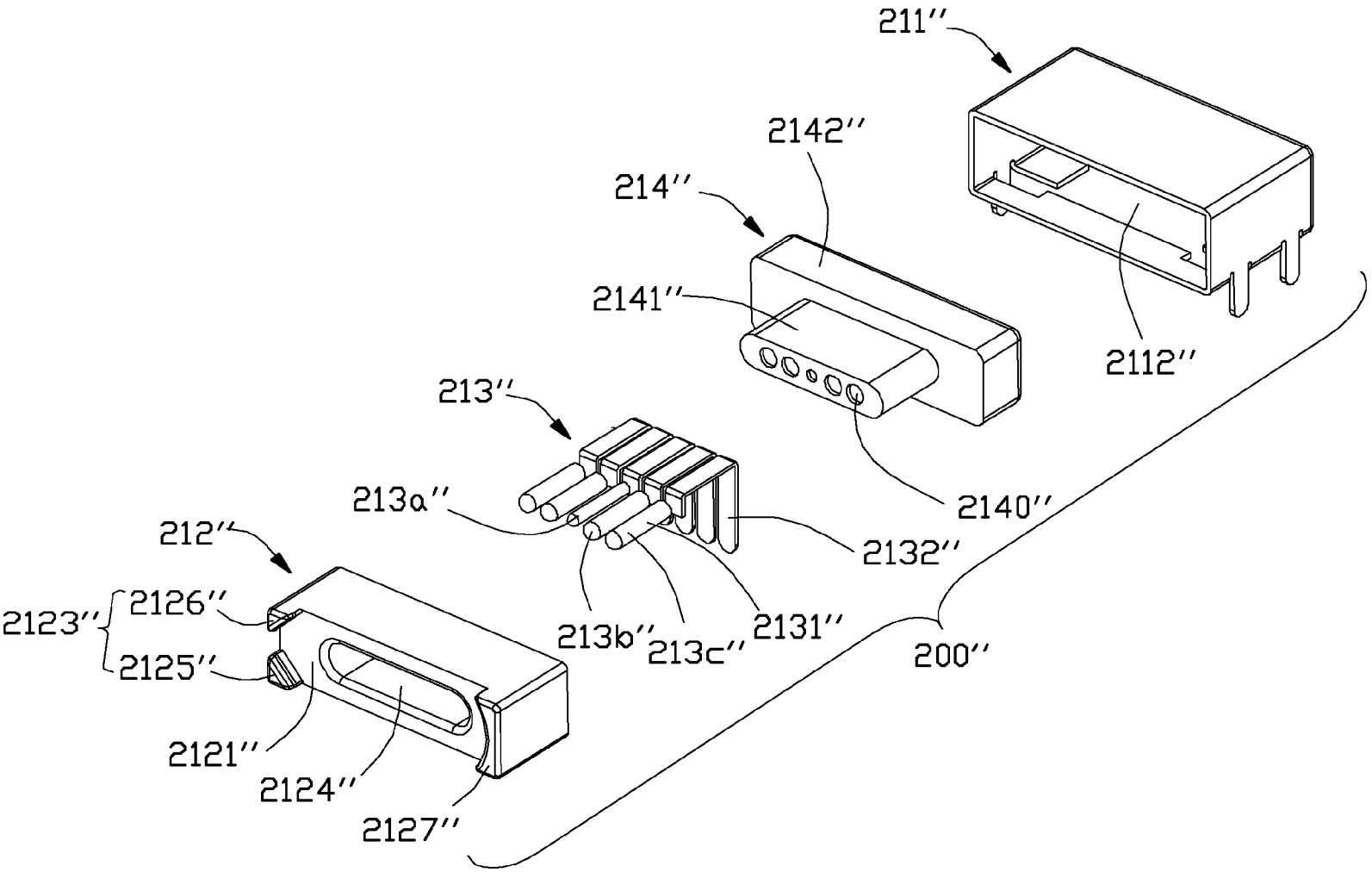
FIG. 30 is a perspective, partially assembled view of the second connector of the electrical connector assembly shown in FIG. 28.
Figure 31:
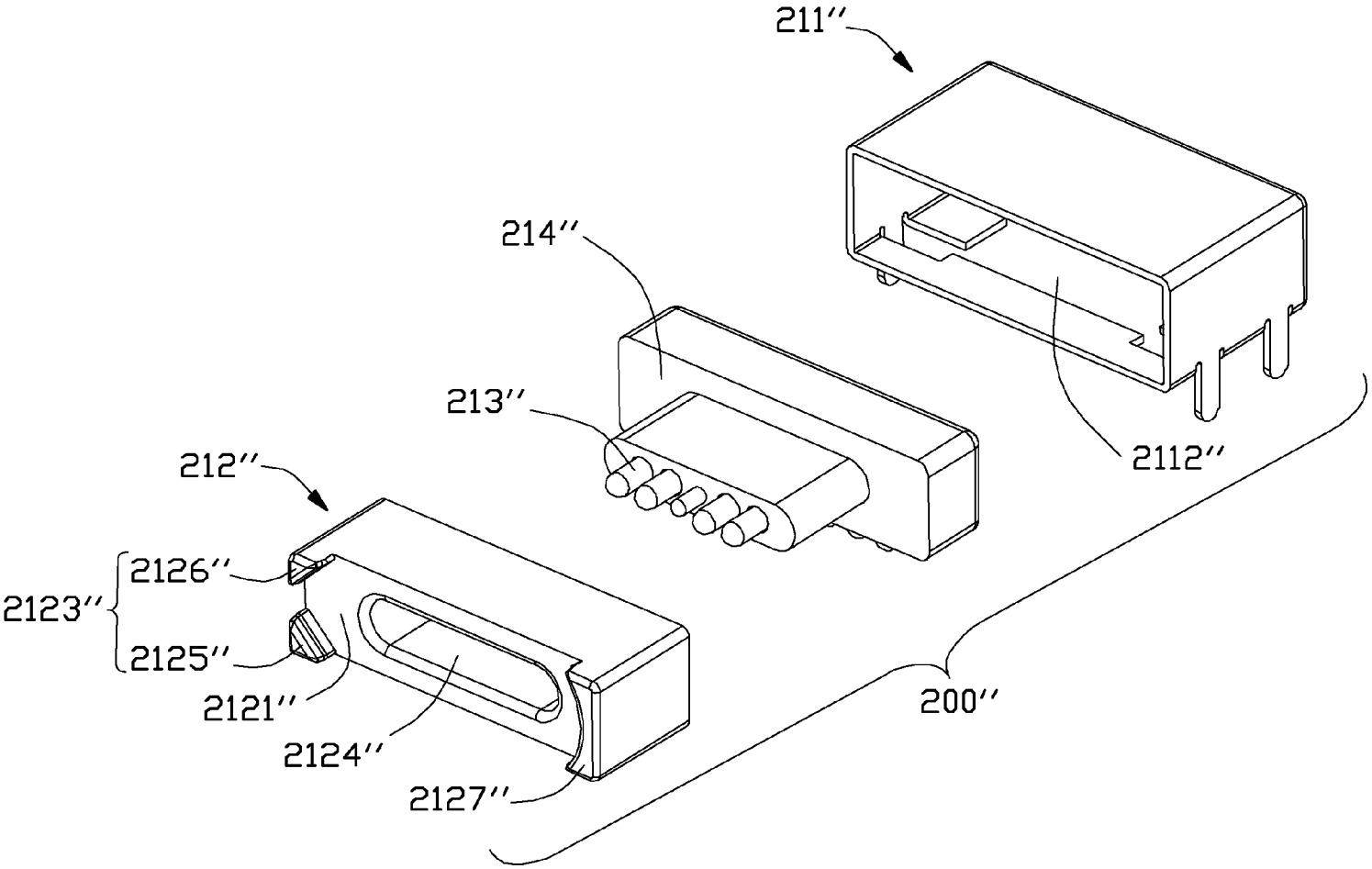
FIG. 31 is a perspective, further assembled view of the second connector of the electrical connector assembly shown in FIG. 30.
Figure 32:
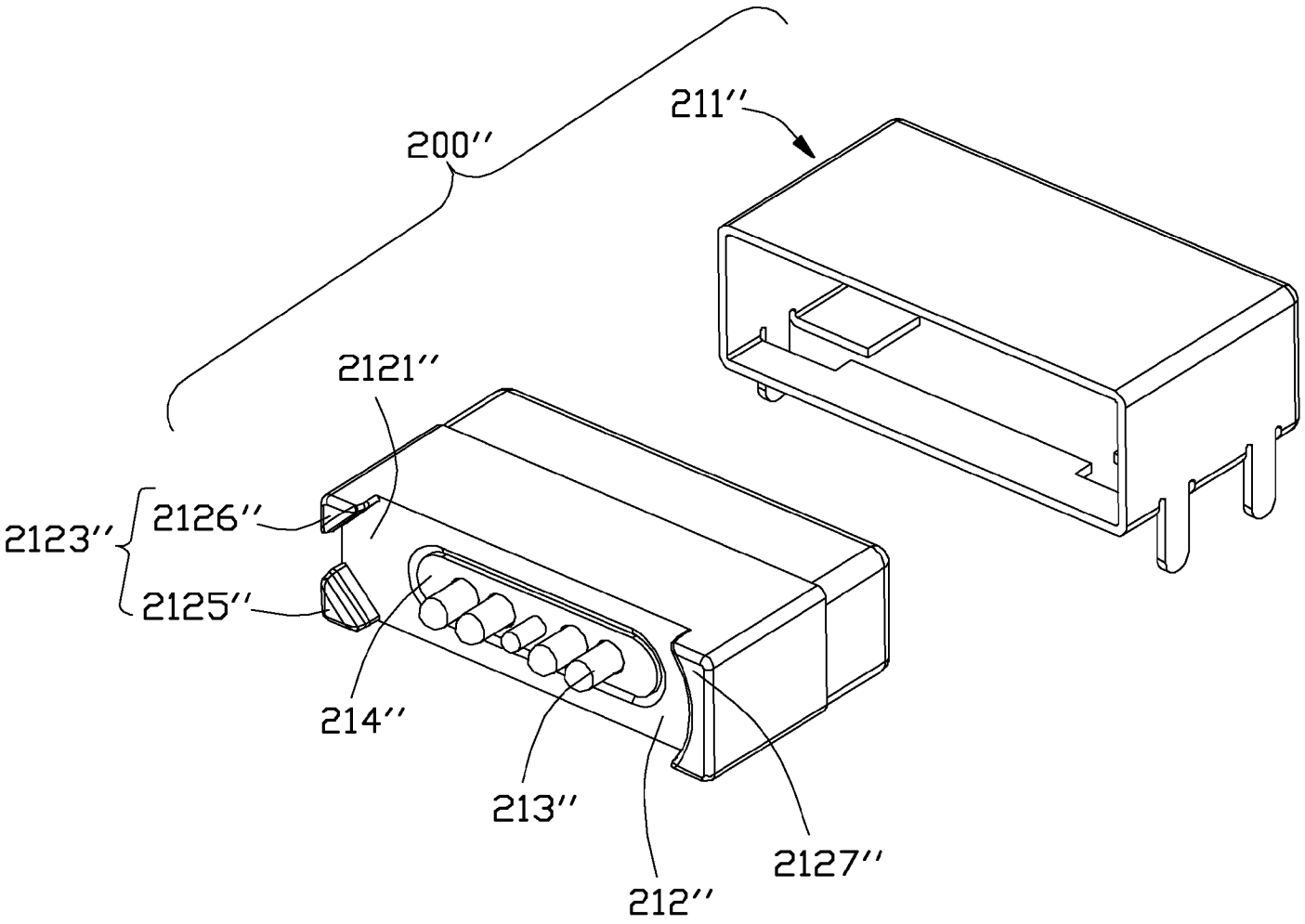
FIG. 32 is a perspective, further assembled view of the second connector of the electrical connector assembly shown in FIG. 31.

Referring to FIGS. 22-32, an electrical connector assembly 1000" in accordance with the third embodiment of the present invention is disclosed. Referring to FIGS. 22 to 23, an electrical connector assembly 1000" of the present embodiment comprises a first connector 100", a second connector 200" and a printed circuit board 230".

Referring to FIGS. 24 to 27, the first connector 100" comprises a plurality of first contacts 113" arranged along the transverse direction, a first spacer 114" accommodating the first contacts 113", a first magnetic element 112" assembled to the first spacer 114", a printed circuit board 115" connecting with the first contacts 113" electrically, a cable 130" connecting with the printed circuit board 115" and a cover 120" assembled to a rear end of the first magnetic element 112" and a front end of the cable 130". The first magnetic element 112" defines a cavity 1121", and the first contacts 113" and the first spacer 114" are accommodated in the cavity 1121".

The first contacts 113" are unretractable, and comprise a first signal contact 113*b*", a pair of first power contacts 113*a*" located on two sides of the first signal contact 113*b*" and a pair of first grounding contacts 113*c*" located on two sides of the first power contacts 113*a*". Each first contact 113" comprises a mating portion 1131" mating with the second connector 200" electrically, a holding portion 1132" extending rearwardly from the mating portion 1131' and fixing the first contact 113", and a connecting portion 1133" extending rearwardly from the holding portion 1132" and connected with the printed circuit board 115". The holding portion 1132" is thicker than the mating portion 1131" and the connecting portion 1133".

The first spacer 114" is made of plastic material, and comprises a main portion 1141" and a rear portion 1142" extending rearwardly from the main portion 1141". The rear portion 1142" is wider than the main portion 1141". The first spacer 114" defines a plurality of grooves 1140" extending through the main portion 1141" and the rear portion 1142" and receiving the first contacts 113". The mating portions 1131" of the first contacts 113" do not exceed the grooves 1140".

The first magnetic element 112" surrounds the main portion 1141", and comprises a base section 1123", a mating section 1122" extending forwardly from the base section 1123" and mating with the second connector 200" and a receiving chamber 1121" extending through the base section 1123" and the mating section 1122". The base section 1123" is thicker than the mating section 1122". The periphery of the mating section 1122" is unsymmetrical in a left-to-right direction. In the embodiment, the mating section 1122" has two different side surfaces in the left-to-right direction. In another embodiment, the periphery of the mating section 1122" can be unsymmetrical in an up-to-down direction.

In assembly, the first contact 113" is assembled to the first spacer 114" with the mating portions 1131" of the first contacts 113" not exceeding a front end of the first spacer 114". The first magnetic element 112" is assembled to the main portion 1141" of the first spacer 114". The first contact 113" and the cable 130" are assembled to the printed circuit board 115" electrically. The cover 120" is assembled to the rear end of the first magnetic element 112" and the front end of the cable 130".

Referring to FIGS. 28 to 32, the second connector 200" comprises a plurality of second contacts 213", a second spacer 214" receiving the second contacts 213", a second magnetic element 212" assembled to the second spacer 214", a second metal shell 211" assembled to the second magnetic element 212". The second magnetic element 212" can attract the first magnetic element 112". The second contacts 213" are accommodated to the second magnetic element 212".

The second contacts 213" comprise a second signal contact 213*b*", a pair of second power contacts 213*a*" located at two sides of the second signal contact 213*b*" and a pair of second grounding contacts 213*c*" located at two sides of the two second power contacts 213*a*". Each second contact 213" comprises a front contact 2131" and a rear contact 2132". The front contact 2131" is a retractable and cylindrical contact. The rear contact 2132" is an unretractable contact, and comprises a holding portion 2135", a mating portion 2134" bent forwardly from the holding portion 2135" and mating with the first connector 100", and a connecting portion 2136" bent rearwardly from the holding portion 2135" and connected with the printed circuit board 230" electrically. The mating portion 2134" and the connecting portion 2136" are perpendicular to the holding portion 2135" respectively. A rear surface of the front contact 2131" resist against a front surface of the rear contact 2132".

The second spacer 214" is made of plastic material, and comprises a main portion 2141" and a rear portion 2142" extending rearwardly from the main portion 2141". The rear portion 2142" is wider than the main portion 2141". The second spacer 214" defines a plurality of grooves 2140" extending through the main portion 2141" and the rear portion 2142" and receiving the second contacts 213". The second magnetic element 212" surrounds the main portion 2141" and defines an anti-mismating hole or receiving cavity 2121" receiving the mating section 1122" of the first connector 100" and a receiving chamber 2124" extending through a front surface and a rear surface thereof. The anti-mismating hole 2121" is unsymmetrical in a left-to-right direction corresponding to the periphery of the mating section 1122", so that the mating section 1122" can enter into the anti-mismating hole 2121" along a signal direction. In the embodiment, the second connector comprises a plurality of first projecting members 2123" and a plurality of second projecting members 2127" extending outwardly from left and right sides of a front surface thereof respectively. The structure of the first projecting members 2123" are different from the structure of the second projecting member 2127". The second projecting member 2127" is a monolithic structure, and the first projecting members 2123" comprises an up projecting member 2126" and a down projecting member 2125" apart from the up projecting member 2126". The anti-mismating hole 2121" is surrounded by the first projecting members 2123' and the second projecting members 2127". The second metal shell 211" surrounds the second magnetic element 212" and defines a receiving space 2112" receiving the second magnetic element 212" and the second spacer 214". In another embodiment, the anti-mismating hole 2121" is unsymmetrical in an up-to-down direction corresponding to the periphery of the mating section 1122".

In assembly, the second contact 213" is assembled to the second spacer 214" with a front end of the second contact 213" exceeding a front end of the second spacer 214". The second magnetic element 212" is assembled to the main portion 2141" of the second spacer 214". At last, the second metal shell 211" is assembled to the second magnetic element 212" and the second spacer 214".

In the third embodiment of the invention, the periphery of the mating section 1122" is unsymmetrical in an up-to-down direction or a left-left direction corresponding to the anti-mismating hole 2121", so that the mating section 1122" can enter into the anti-mismating hole 2121" along a single direction. When the first connector 100" enters into the second connector 200" in a right way, the mating section 1122" of the first connector 100" corresponds to the anti-mismating hole 2121" and mates with the second connector 200". When the first connector 100" enters into the second connector 200" in a wrong way, the mating section 1122" of the first connector 100" can not enter into anti-mismating hole 2121" and then can not mate with the second connector 200".

In the first, second and third embodiments of the invention, the panel (220, 220') and a whole structure comprising the anti-mismating hole 2121" and the projecting members (2123", 2127") are collectively called an anti-mismating structure. The port (2201, 2201') is also called an anti-mismating hole. A structure surrounding the port (2201, 2201') and the projecting members (2123", 2137") surrounding the anti-mismating hole 2121" are collectively called anti-mismating elements.

What is claimed is:

1. An electrical connector assembly comprising:

a first connector comprising a mating section, a first magnetic element having a cavity, and a plurality of first contacts accommodated in the mating section and the cavity;

a second connector for mating with the mating section, the second connector comprising a second magnetic element and a plurality of second contacts accommodated in the second magnetic element; and an anti-mismating structure located at a front end of the second connector, the structure comprising a plurality of anti-mismating elements and an anti-mismating hole surrounded by the anti-mismating elements, the anti-mismating hole for receiving the mating section;

wherein the anti-mismating hole is asymmetric in one of an up-to-down direction and a left-to-right direction, and the periphery of the mating section corresponds to the anti-mismating hole;

wherein the anti-mismating elements comprise a plurality of projecting members projecting from a front surface of the second magnetic element, and the anti-mismating hole is surrounded by the projecting members;

wherein the projecting members comprise a plurality of first projecting members and a plurality of second projecting members projecting from left and right sides of a front surface of the second magnetic element respectively.

2. The electrical connector assembly as claimed in claim 1, wherein each of the first contacts has a front surface rearwardly of a front surface of the first magnetic element, and each of the second contacts has a front surface forwardly of a front surface of the second magnetic element.

3. The electrical connector assembly as claimed in claim 2, wherein the first connector and the second connector comprise a first spacer and a second spacer receiving the first contacts and the second contacts, respectively.

4. The electrical connector assembly as claimed in claim 3, wherein the first contacts are retractable, the second contacts are unretractable, and the front surface of the first contact is located forwardly of a front surface of the first spacer.

5. The electrical connector assembly as claimed in claim 3, wherein the first contacts are unretractable, the second contacts are retractable, and the front surface of the first contact is located rearwardly a front surface of the first spacer.

6. The electrical connector assembly as claimed in claim 1, wherein the mating section is defined into the first magnetic element, and the periphery of the first magnetic element is asymmetric in one of an up-to-down direction and a left-to-right direction and corresponds to the anti-mismating structure for entering into the second connector along a single direction.

7. The electrical connector assembly as claimed in claim 1, wherein the first connector and the second connector comprise a first metal shell and a second metal shell assembled to the first magnetic element and the second magnetic element, respectively, and the mating section is defined into the first metal shell.

8. The electrical connector assembly as claimed in claim 1, wherein the first contacts and the second contacts comprise a power contact, a grounding contact, and a signal contact located between the power contact and the grounding contact respectively, each second contact comprises a front contact and a rear contact, and a rear surface of the front contact resists against a front surface of the rear contact.

9. The electrical connector assembly as claimed in claim 1, wherein the first connector comprises a printed circuit board connecting with the first contacts, a cable connecting with the printed circuit board, and a cover assembled to a rear end of the first magnetic element and a front end of the cable.

10. An electrical receptacle connector assembly comprising:

an insulative housing defining an outer contour which is symmetrically arranged in both a longitudinal direction and a vertical direction perpendicular to each other;

a plurality of contacts disposed in the housing with corresponding contacting sections extending forwardly out of a front face of the housing and immovable along a front-to-back direction perpendicular to both said longitudinal direction and said vertical direction, said contacting sections being symmetrically arranged along said longitudinal direction;

a first magnetic element enclosing said and defining with a front receiving cavity into which the immovable contacting sections extend forwardly; and the receiving cavity is asymmetrically arranged in the longitudinal direction for assuring only one orientation is allowed for insertion of a corresponding plug connector wherein said plug includes a second magnetic element having a same asymmetrical arrangement with receiving cavity; wherein the second magnetic element of said plug connector extends into and occupies the receiving cavity, and includes a plurality of retractable contacts to be pushed backward by the immovable contacts, respectively.

11. The electrical connector assembly as claimed in claim 10, wherein different protrusions are formed on the magnetic element to define the receiving cavity to perform said one orientation for anti-mismating.

12. An electrical receptacle connector assembly comprising:

an insulative housing defining an outer contour which is symmetrically arranged in both a longitudinal direction and a vertical direction perpendicular to each other;

a plurality of contacts disposed in the housing with corresponding contacting sections extending forwardly out of a front face of the housing and immovable along a front-to-back direction perpendicular to both said longitudinal direction and said vertical direction, said contacting sections being symmetrically arranged along said longitudinal direction;

a first magnetic element enclosing said housing with the immovable contacting sections extending forwardly beyond both the housing and the magnetic element along the front-to-back direction; and a panel discretely spaced from and located in front of the first magnetic element with a through opening aligned with the first magnetic element in said front-to-back direction; wherein the through opening is asymmetrically arranged in the vertical direction for assuring only one orientation is allowed for insertion of a corresponding plug connector, wherein said plug connector includes a second magnetic element having a same asymmetrical arrangement with the through opening while the first magnetic element defines a symmetrical arrangement in both the longitudinal direction and the vertical direction; wherein the second magnetic element of said plug connector extends through the through opening to contact the first magnetic element in the front-to-back direction, and includes a plurality of retractable contacts to be pushed backward by the immovable contacts, respectively.

* * * * *